US006375391B1

(12) United States Patent
Børseth et al.

(10) Patent No.: US 6,375,391 B1
(45) Date of Patent: Apr. 23, 2002

(54) GUIDE DEVICE FOR PRODUCTION RISERS FOR PETROLEUM PRODUCTION WITH A "DRY TREE SEMISUBMERSIBLE" AT LARGE SEA DEPTHS

(75) Inventors: Knut Børseth, Tårnåsen; Ola Often, Stabekk, both of (NO)

(73) Assignee: PGS Offshore Technology AS, Lysaker (NO)

( * ) Notice: Subject to any disclaimer, the term of this patent is extended or adjusted under 35 U.S.C. 154(b) by 0 days.

(21) Appl. No.: 09/533,406

(22) Filed: Mar. 23, 2000

(30) Foreign Application Priority Data

Mar. 25, 1999 (NO) ..... 1999.1470
Feb. 18, 2000 (NO) ..... 2000.0831

(51) Int. Cl.[7] ..... E21B 17/01; B63B 22/00

(52) U.S. Cl. ..... 405/224.4; 405/211; 405/223.1; 405/224.4; 166/367; 114/264; 441/133

(58) Field of Search ..... 405/195.1, 223.1, 405/201, 221, 216, 224.2–224.4; 166/350, 359, 367; 114/264, 265; 441/133

(56) References Cited

U.S. PATENT DOCUMENTS 3,572,272 A * 3/1971 Dixon et al. ..... 114/294
4,126,183 A 11/1978 Walker ..... 166/338

(List continued on next page.)

FOREIGN PATENT DOCUMENTS

GB 2 139 570 A 11/1984
GB 2 147 549 A 5/1985
NO 174920 8/1994
NO 307223 1/2000
WO WO 95/28316 10/1995
WO WO 97/29944 A1 8/1997
WO WO 99/10230 3/1999

OTHER PUBLICATIONS

R. Bridges et al., "Spar Systems for West Africa," Angola Energy Summit, 2nd–3rd Mar. 1999, London, UK.
TPG drilling platform sales brochure, Technip–Geoproduction, Paris France (undated).

*Primary Examiner*—Thomas B. Will
*Assistant Examiner*—Tara L. Mayo
(74) *Attorney, Agent, or Firm*—Rothwell, Figg, Ernst & Manbeck

(57) ABSTRACT

A system for use in petroleum production at sea includes a guide frame for one or more riser pipes, on a semisubmersible production vessel. One or more main buoyancy member are arranged separately on at least one riser to carry the main part of the riser's weight. Each riser separately carries a Christmas tree on its top, near a main deck of the vessel. The guide frame comprises vertical main elements extending vertically downwards from the deck, through the splash zone and through the upper, more wave- and current-influenced zone of the sea. The guide frame also includes horizontal guide plates comprising vertically open cells formed of a horizontally arranged framework of beams. Lateral stabilization devices guide the risers' and the main buoyancy members' vertical movement relative to the vessel and restrict horizontal movement of the risers with respect to the guide frame. The guide plates are arranged in at least two levels on the guide frame. A lower guide plate is arranged at the lower ends of the vertical main elements', and a guide plate is arranged just below or near the splash zone. At least one main buoyancy member is held on the riser in level with, and guided by, lateral stabilization devices arranged in one or more guide plates below the upper, more wave- and current-influenced zone near the sea surface. The risers are without buoyancy elements through the splash zone, and thus are less exposed to the water forces in the upper zone of the sea.

35 Claims, 17 Drawing Sheets

U.S. PATENT DOCUMENTS 4,176,986 A 12/1979 Taft et al. ..... 405/211
4,295,758 A * 10/1981 Yashima ..... 405/201
4,477,207 A * 10/1984 Johnson ..... 166/350 X
4,646,840 A * 3/1987 Bartholomew et al. ..... 166/350
4,708,525 A 11/1987 Beynet et al. ..... 405/224.2
4,716,972 A 1/1988 Mäkinen et al. ..... 175/8
4,741,647 A 5/1988 Dumazy et al. ..... 405/224.4
4,895,481 A 1/1990 Pepin-Lehalleur et al. .. 405/224
4,909,327 A * 3/1990 Roche ..... 166/359
4,934,871 A * 6/1990 Kazokas, Jr. ..... 405/224
5,551,802 A * 9/1996 Wybro ..... 405/223.1
5,558,467 A 9/1996 Horton ..... 405/195.1
5,697,447 A * 12/1997 Borseth ..... 166/366
5,738,464 A 4/1998 Delrieu ..... 405/202
5,971,075 A 10/1999 Odru et al. ..... 166/350
6,004,074 A * 12/1999 Shanks, II ..... 405/195.1
6,190,091 B1 * 2/2001 Byle ..... 405/224.4
6,176,646 B1 * 6/2001 Finn et al. ..... 405/224.2
6,257,337 B1 * 7/2001 Wells ..... 166/350

* cited by examiner

GUIDE DEVICE FOR PRODUCTION RISERS FOR PETROLEUM PRODUCTION WITH A "DRY TREE SEMISUBMERSIBLE" AT LARGE SEA DEPTHS

INTRODUCTION

This application claims priority to Norwegian patent application Ser. No. 1999.1470, filed Mar. 25, 1999 and Norwegian patent application Ser. No. 2000.0831, filed Feb. 18, 2000. This application concerns a frame for stabilizing risers on a petroleum production vessel, preferably for production risers with "dry" wellheads, i.e. with Christmas trees arranged on the deck of a freely floating platform. The petroleum production considered takes place at very large sea depths, very likely more than 1200–1600 meters.

APPROACH TO THE PROBLEM

The invention is in one embodiment adapted for use in sea areas with the estimated wave height $H_{max}$ being in the order of amplitudes between 5 and 10 m, thus considerably less than the $H_{max}$ in the order of 25–30 m required for areas in the North Sea, conditions requiring considerably larger dimensioned and consequently heavier, more expensive vessels. A considerable problem in petroleum production at sea is to guide risers through the splash zone and the upper current- and wave-affected zone below the sea surface. In this zone, large tensions, tension variations, bending moments, wave actions and accelerations occur on the risers and their connection points, for example Christmas trees.

PRIOR ART

The prior art is described in the patent specifications GB 2 147 549, U.S. Pat. No. 5,558,467, and WO 95/28316. A similar shallow water construction which is not a vessel, and which cannot be applied in deep water, is described in GB 2 139 570.

"Spar" Buoy

A deep semisubmersible construction called a "Spar" buoy, may be adapted for production drilling, petroleum production or storing of petroleum fluids at sea. Such a design can consist of one single, heavily ballasted, column of very deep draught, having a relatively large buoyancy volume arranged at a high level in the column, at or below the water surface, and having a column through the splash zone and a work deck above water. The lower ballasted part can comprise a framework. Such a column stabilized construction design has little heave or vertical movement but its large draught can entail that even small angular movements, as measured in degrees, still entails considerable horizontal accelerations near the top and the lower end of the construction. Such a deep column-stabilized design has an advantage in that it encloses the risers in the critical area from the splash zone at the sea surface and down to a depth more than 100 meters so that wave and current forces do not reach the upper part of the risers. Such a design has economic disadvantages in that the deep draught requires heavier plate dimensioning to resist the higher water pressure. Heavier dimensioned steel plates entails higher weight and price. The deep draught of the assembled operative platform requires assembly at deep draught in deep water near the field, meaning higher lifting and assembly costs.

WO 99/10230 "Buoyant substructure for offshore platform" describes a buoyant substructure floating vertically standing in the sea (e.g. as an offshore platform) comprising at least three separate columns being interconnected. At least one of the columns is arranged to be ballasted by the end which is arranged to have deep draught, where the columns are interconnected by short beams.

NO 174 920 "Flexible marine platform with surface production wells is described as a platform consisting of a rigid construction carrying a deck, pontoons fixed to the lower part of the rigid construction and a flexible construction constituted by columns fixed by their upper ends to the rigid construction and to the pontoons, and by their lower ends to a foundation arranged at the seabed, whereby the columns are in tension. Guide plates are illustrated, but no buoyancy elements on the risers.

Tension Leg Platforms

Another solution for production platforms is tension leg platforms, so-called TLP's. Tension leg platforms are anchored via vertical tension legs or tethers anchored to the sea bed. The risers of such a tension leg platform may be guided by guide plates described in PCT publication WO 97/29944 and published Norwegian patent application NO 1998.3337, so that the risers get a parallel and small relative vertical movement relative to the platform deck and relative to each other. The tension legs are usually anchored with pile suction anchors, being vacuum-sucked down into the sediments in the sea bed, or gravity based structures on the seabed. At least two problems occur with such an anchoring solution:

a) At the large depths which may be in question: more than 1200–1600 meters, the seabed sediments may consist of less compacted unconsolidated organic mud, fine silt and clay particles with low density, low shear resistance and high water content, as distinct from glacially worked compacted clay/sand-containing sediments which constitute an essential part of the sea bed in the North Sea and the Norwegian Sea.

b) The sea bed can contain petroleum fractions forming so-called "hydrates" being kept in a partial frozen phase at shallow depths below the sea bed and is presumed to be deposited from escaping petroleum fluids from deeper geological layers at higher temperatures. These hydrates are unstable and can pass to the gas/liquid phase if they are supplied with heat. In a sedimentary basin, deeper geological layers usually have a higher temperature than the surface layers. Petroleum production entails a heat transfer from the upwardly flowing/rising petroleum fluids in top of the well, to and may result in an unwanted fluidization of hydrates in layers close to the seabed. Thus, there is a risk of gas formation at the suction anchors and a risk for sudden loss of tension in a tension leg.

In deeper waters the separation between the risers must be large in order to avoid collision during hydrodynamic drag. This separation usually requires a larger and thus heavier tension leg platform.

Semisubmersible Platform

A third solution is ordinary column stabilized or semisubmersible constructions in the form of platforms. An essential problem with semisubmersible constructions with an open moonpool is that the production risers will hang freely movable and unstabilized through the splash zone and the upper water masses. This is difficult if there are buoyancy members on the risers, and especially if the buoyancy members are arranged in the splash zone, because, as mentioned above, problems with wave forces laterally and vertically on the buoyancy members and the risers occur.

SHORT SUMMARY OF THE INVENTION

A solution to the above mentioned problems is given according to one embodiment of the invention as defined in the patent claims enclosed: A system for use in petroleum production at sea, includes a guide frame for one or more riser pipes on a semisubmersible production vessel with one or more main buoyancy member arranged separately on at least one riser to carry the main part of the riser's weight. Each riser is arranged for separately carrying a Christmas tree on top, near the deck of the vessel. The guide frame comprises vertical main elements arranged to extend vertically downwards from the deck, through the splash zone and through the upper, more wave- and current-influenced zone of the sea, down to a depth of about 50–150 meters below the sea surface, where drag forces are less pronounced. The novel features by the invention is as follows:

The guide frame has horizontal guide plates comprising vertically open cells formed of a horizontally arranged framework, preferably of beams, with lateral stabilization devices for guiding the risers' and the main buoyancy members' vertical relative movement and restricting the horizontal relative movement with respect to the guide frame.

The guide plates are arranged in at least two levels on the guide frame: (1) a lower guide plate is arranged at the lower ends of the vertical main elements of the guide frame, and (2) another guide plate is arranged at or just below the splash zone.

One main buoyancy member is arranged for being held on the riser preferably in level with, and guided by the lateral stabilization devices arranged in the lower guide plate, below the upper, more wave- and current-influenced zone near the sea surface, and with the risers being essentially without buoyancy elements through the splash zone, for being less exposed to the environmental water forces, e.g. drag, in the upper zone of the sea.

More specifically, the invention concerns a framework for arrangement in a production moonpool in a semisubmersible platform. In a preferred embodiment the semisubmersible platform has a square-shaped ring pontoon. The main proportion of wave-influence and current, exerting horizontal drag forces on risers, takes place in the upper 150 meters below the sea surface. These horizontal forces normally decrease strongly with increasing depth below the surface. According to a preferred embodiment of the invention, each riser is arranged with main buoyancy members or, so-called "cans", arranged below the splash zone and the most strongly wave-influenced zone, so that they carry the main part of the weight of the riser in the sea. Thus the essential part of the carrying capacity represented by the wide-diameter buoyancy members is arranged in a depth zone where weaker drag forces are exerted. The diameter of auxiliary buoyancy elements is smaller further up, in order not to be so strongly affected by the more strongly wave- and current influencing zone of the water. Preferably the riser pipe is "naked" through the splash zone, giving minimum attack surface for waves and current. The auxiliary buoyancy members may be arranged further upwards on the riser, to carry the local weight of the risers above the main buoyancy members. Below the buoyancy members, the risers are in tension. At a certain level between the buoyancy members and the wellhead on top of the riser, the longitudinal forces in the riser pipe pass from tension to compression. Thus each riser pipe according to the invention will carry a wellhead on top, being vertically arranged for free vertical movement relative to the platform deck. By reducing the exposed diameter of equipment crossing the splash zone, drag forces incurred by water currents and waves that pull or bend the riser laterally are minimized. The framework according to the invention is arranged to stiffen up the risers laterally in the current- and wave-influenced zone. In a preferred embodiment of the invention the framework extends to a depth of about 70 to 80 meters. The framework comprises, in a preferred embodiment of the invention, several levels with grid-like horizontal frames with one opening for each riser, with the opening preferably also containing a main or auxiliary buoyancy member. In the preferred embodiment, all openings for risers are sufficiently wide in order for the main buoyancy members to be set down through the framework right from the top. The largest buoyancy members are arranged in the deeper, less wave-influenced parts of the framework. This invention differs in this manner essentially from a so-called "Spar"-buoy having the main buoyancy members arranged in or near the splash zone, protected through the splash zone by the surrounding cylindrical wall constituted by the column of the buoy.

SHORT DESCRIPTION OF THE DRAWINGS

The invention is illustrated in the following drawing figures stating non-limiting examples of an embodiment of the invention.

FIG. 1*a* illustrates a combined elevation view and vertical section of a semisubmersible platform, having a ring pontoon, and a partial view, partial vertical section of the guide frame for risers with buoyancy elements according to the invention. In a preferred embodiment, a separate wellhead derrick is arranged mobile on two sets of rails so that the wellhead derrick can be moved over a selected well in the production moonpool. As illustrated, a drilling derrick may be fixed.

FIG. 1*b* shows similarly to FIG. 1*a,* a situation with the guide frame for risers being raised with its lower end generally to the same level as the lower edge (bottom) of the ring pontoon. A work-over derrick is here illustrated being driven aside from the production moonpool to give free way over the production moonpool for elevating the frame according to the invention.

Figure 4A:
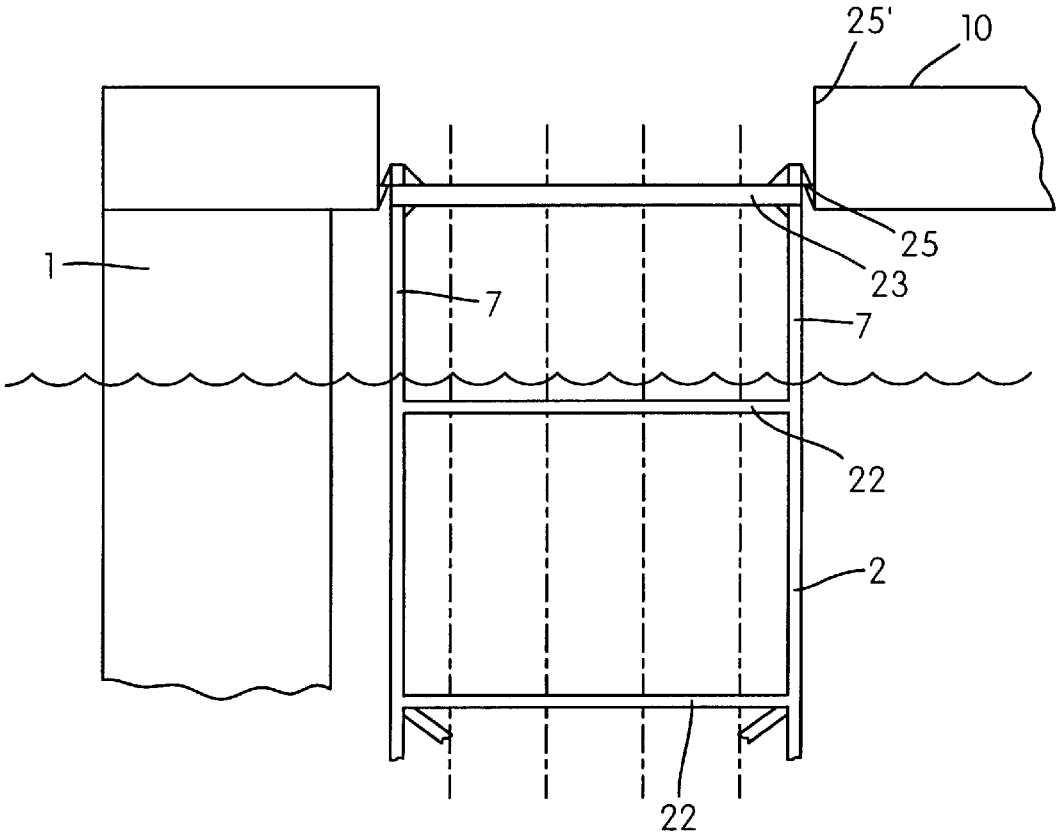

FIG. 4*a* is a section view illustrating a flange on the upper end of the vertical main members of the frame, the flange being arranged to be hung up in a frame in the production deck of the platform.

Figure 4B:
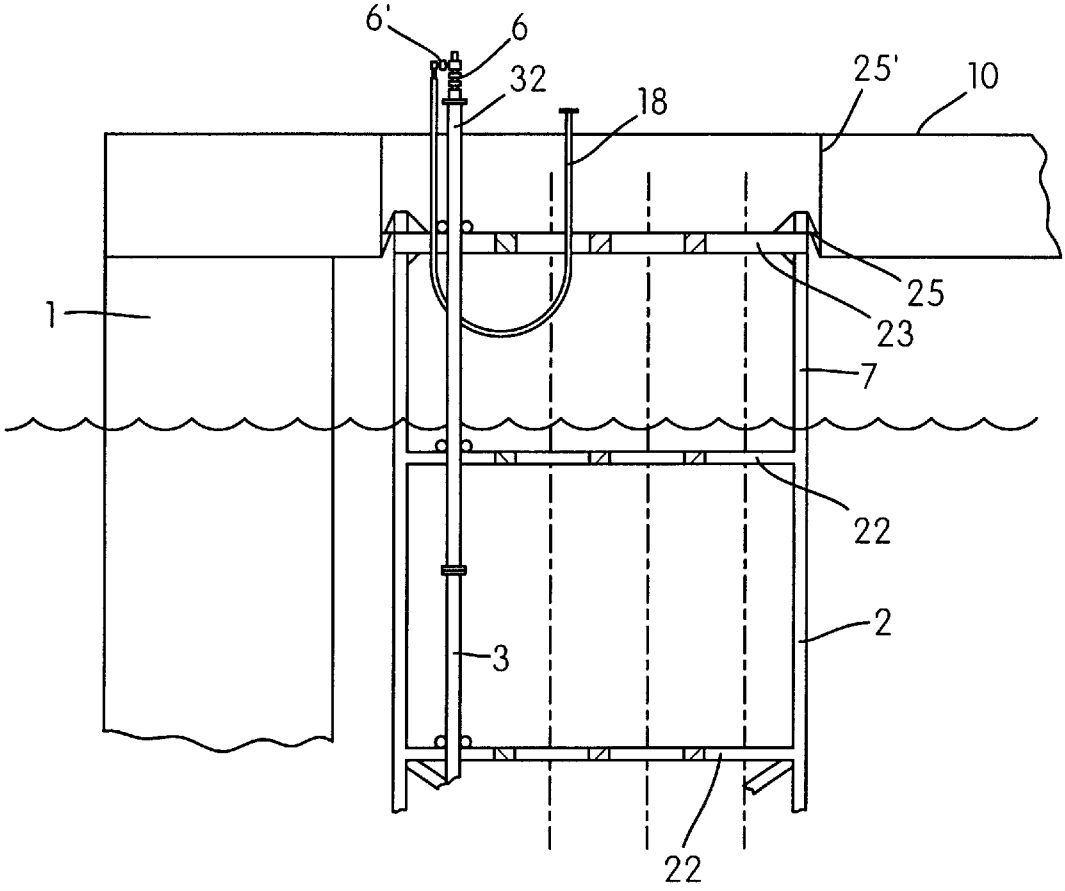

FIG. 4*b* is a more detailed vertical section of the top deck of the guide frame and illustrating a Christmas tree arranged standing on the riser pipe's upper end.

Figure 4C:
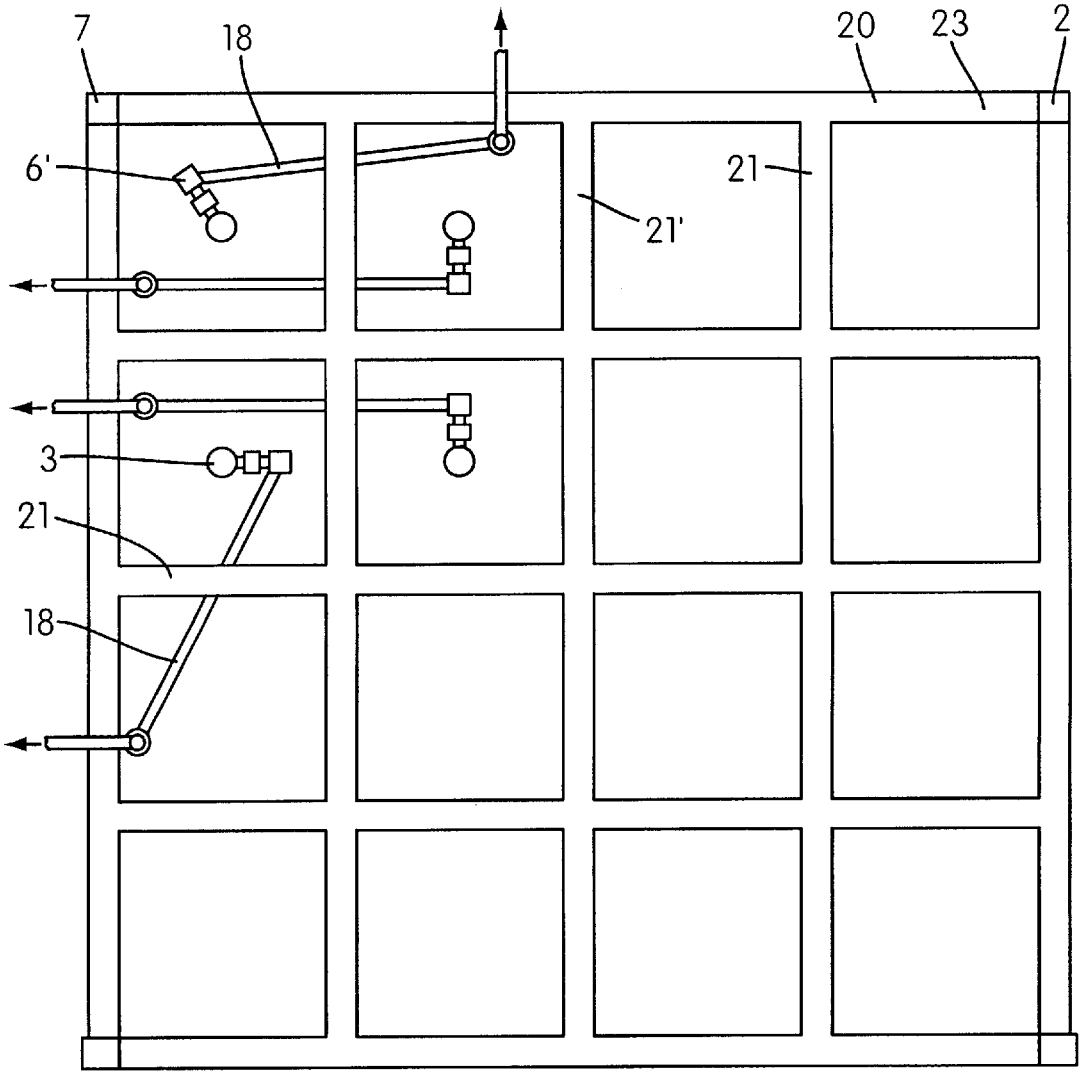

FIG. 4*c* shows a plan view of the top deck of the guide frame with openings in each cell for a flexible U-hose leading from a projecting wing valve and further connected directly or indirectly to pipes on the production deck.

Figure 5A:
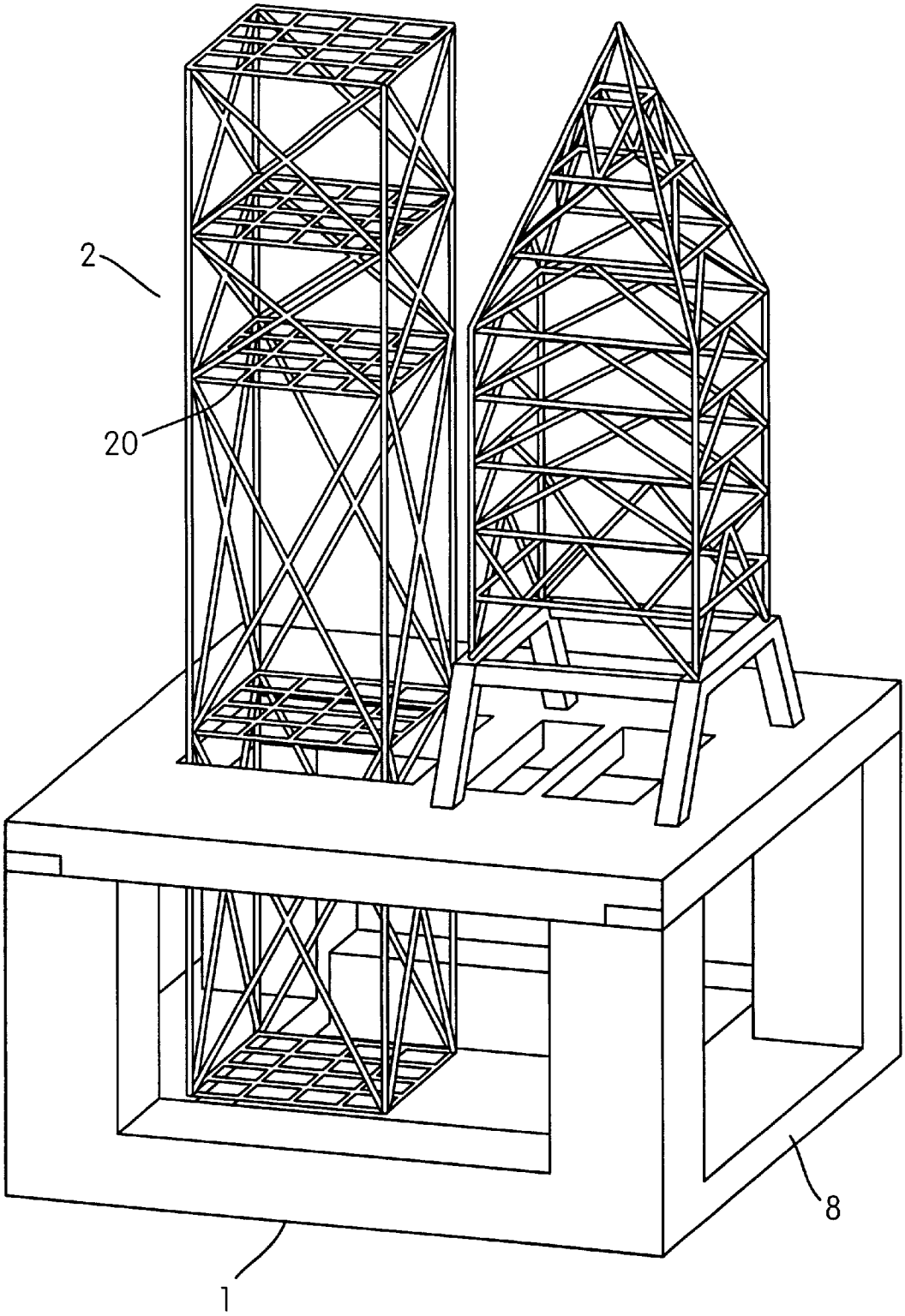

FIG. 5*a* shows, in an isometric illustration seen from a position above the horizontal, a semisubmersible platform with a guide frame according to the invention, the guide frame being raised or jacked up.

Figure 5B:
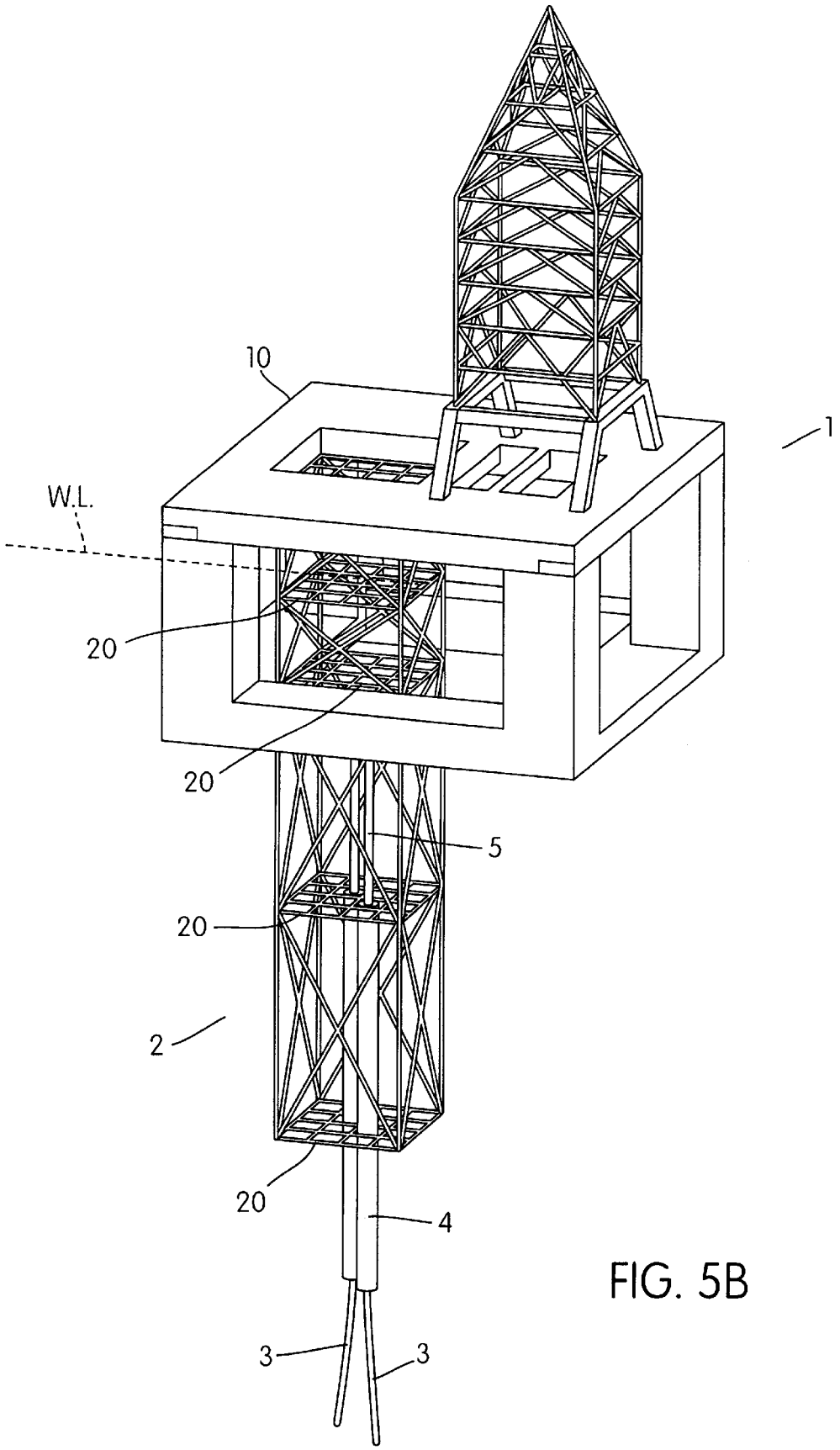

FIG. 5*b* is an isometric illustration as seen from a position above the horizontal, a semisubmersible platform with a guide frame according to the invention, the guide frame being lowered to a submerged operational position. Some risers, each provided with buoyancy elements are illustrated.

Figure 5C:
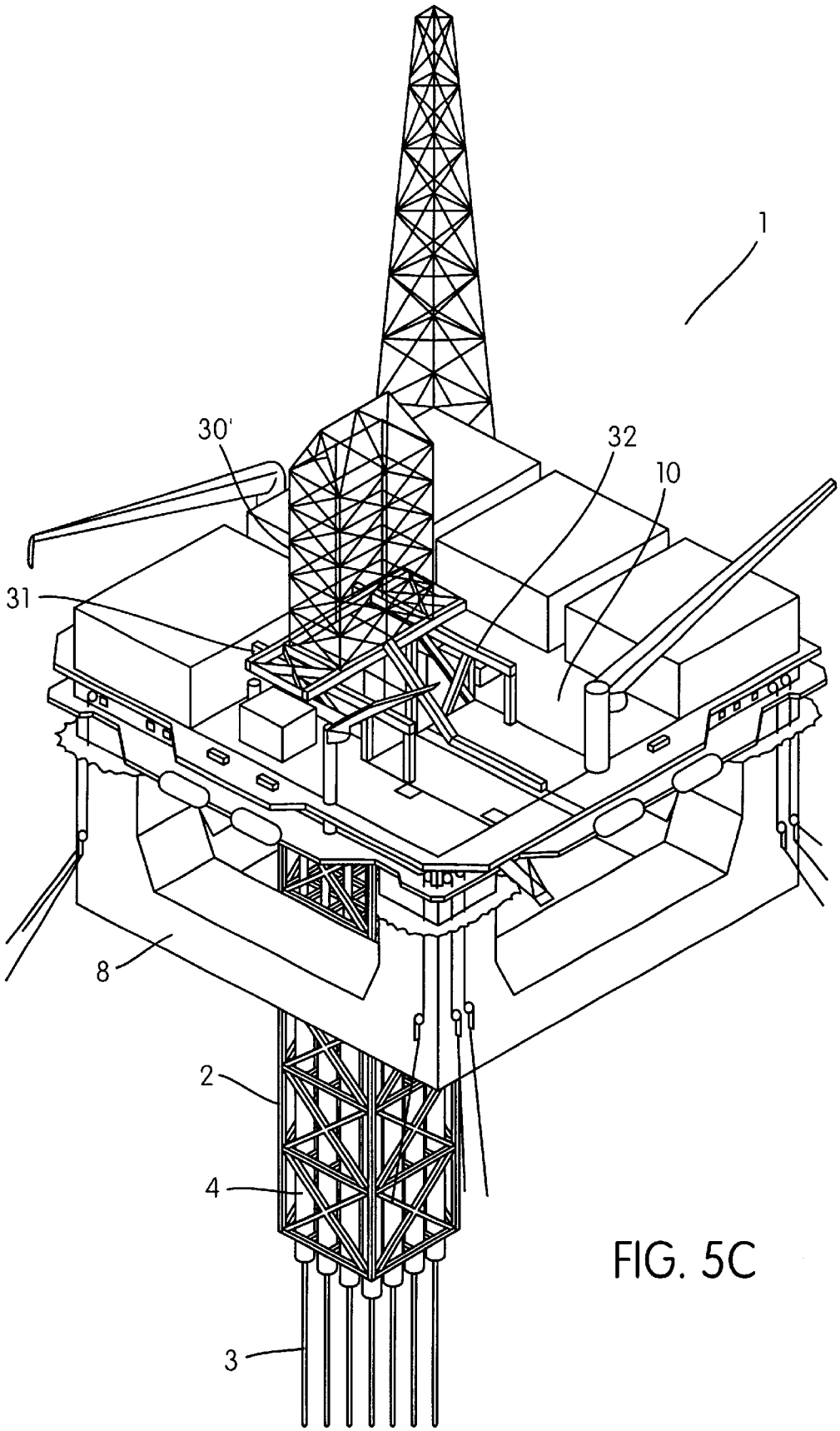

FIG. 5*c* illustrates a preferred embodiment of the invention, with a mobile work-over derrick arranged over the guide frame with 4×4 dry wellheads and risers tensioned by buoyancy elements arranged as keeljoints.

Figure 6:
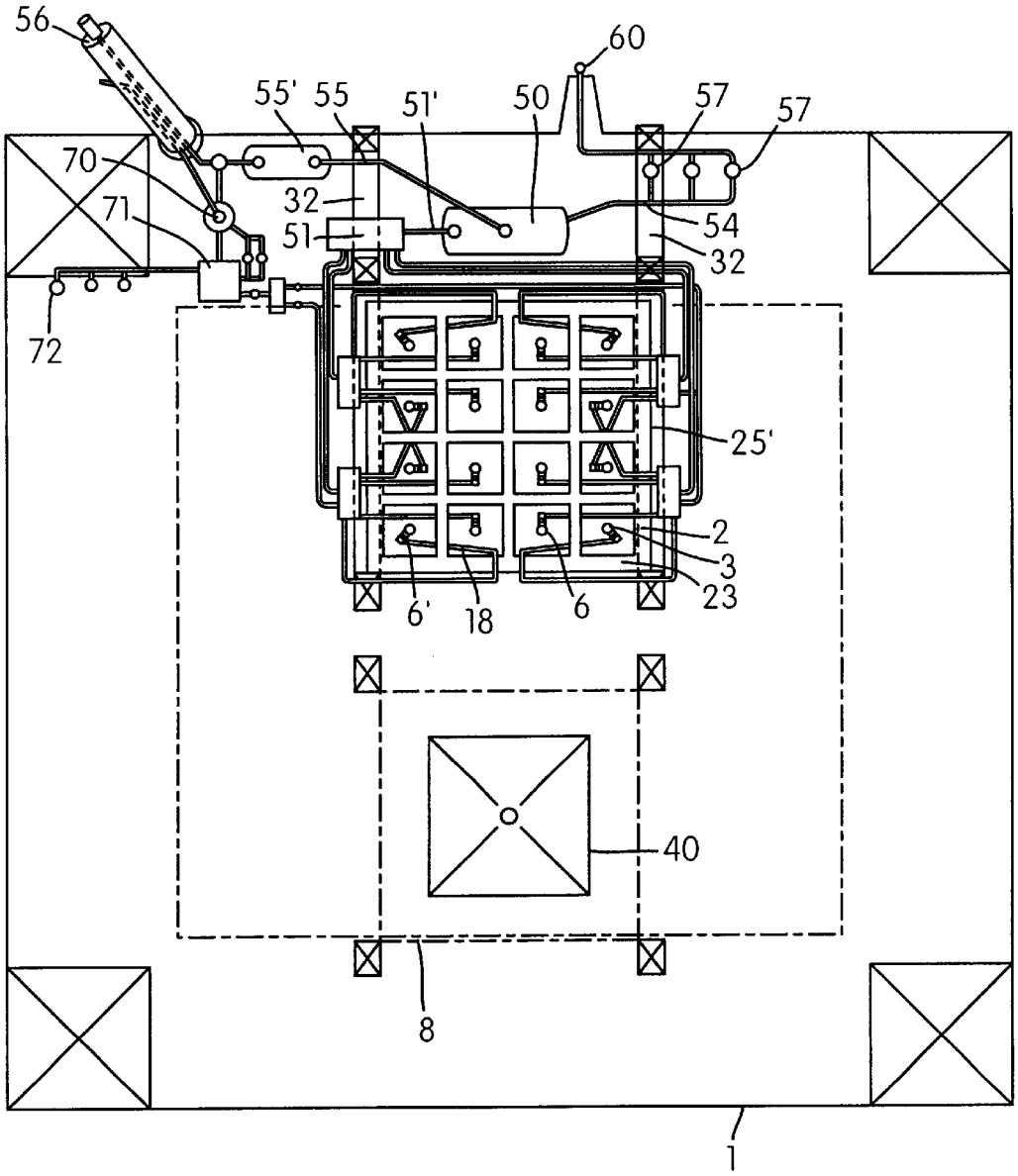

FIG. 6 shows a rough deck plan view of a platform in a system with flexible pipes connecting the risers to the production deck according to a preferred embodiment of the invention.

Figure 7:
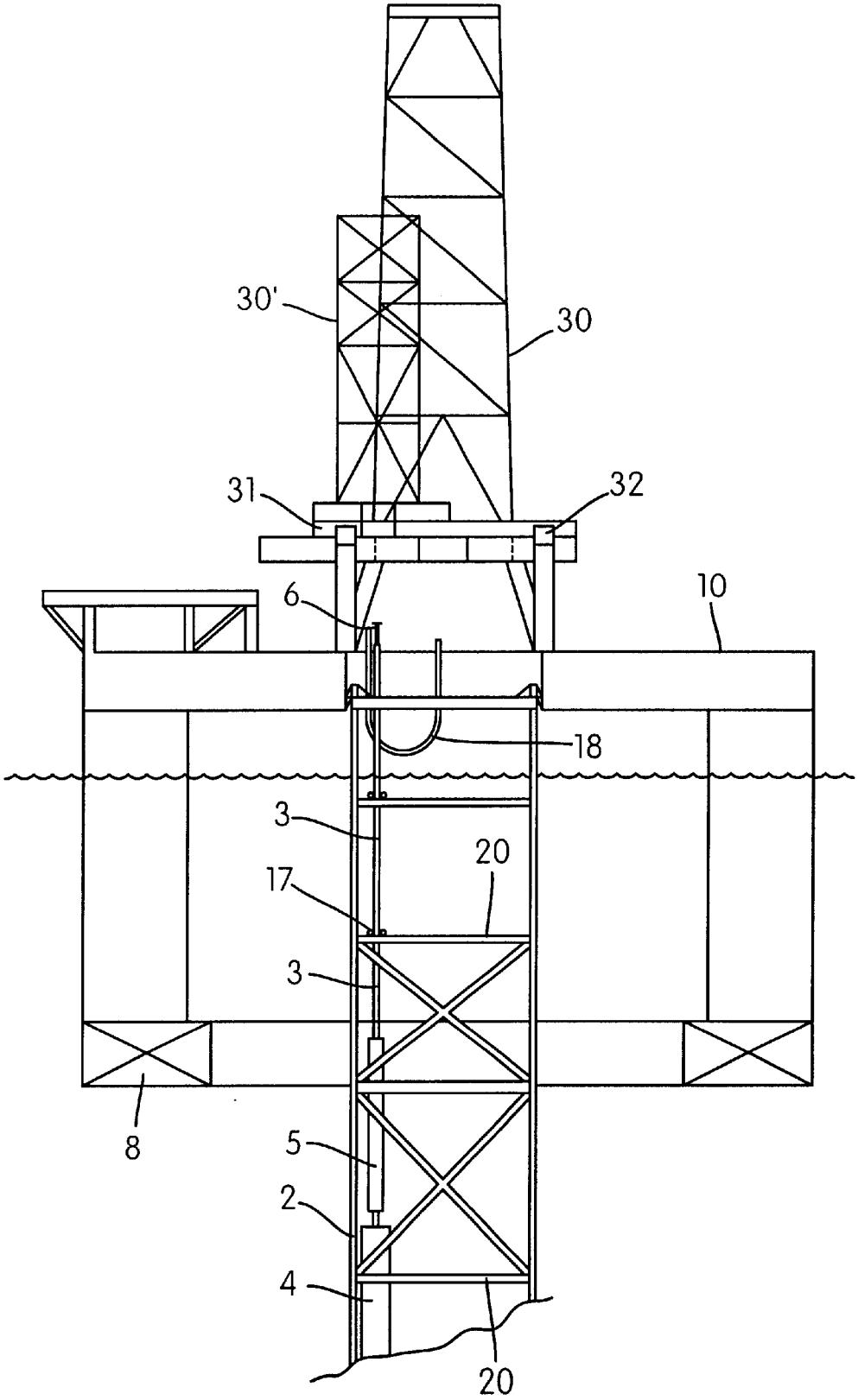

FIG. 7 is a section of the main deck and shows the derrick arranged movable on two crossing sets of rails one set being normal to the sectional plan.

Figure 8:
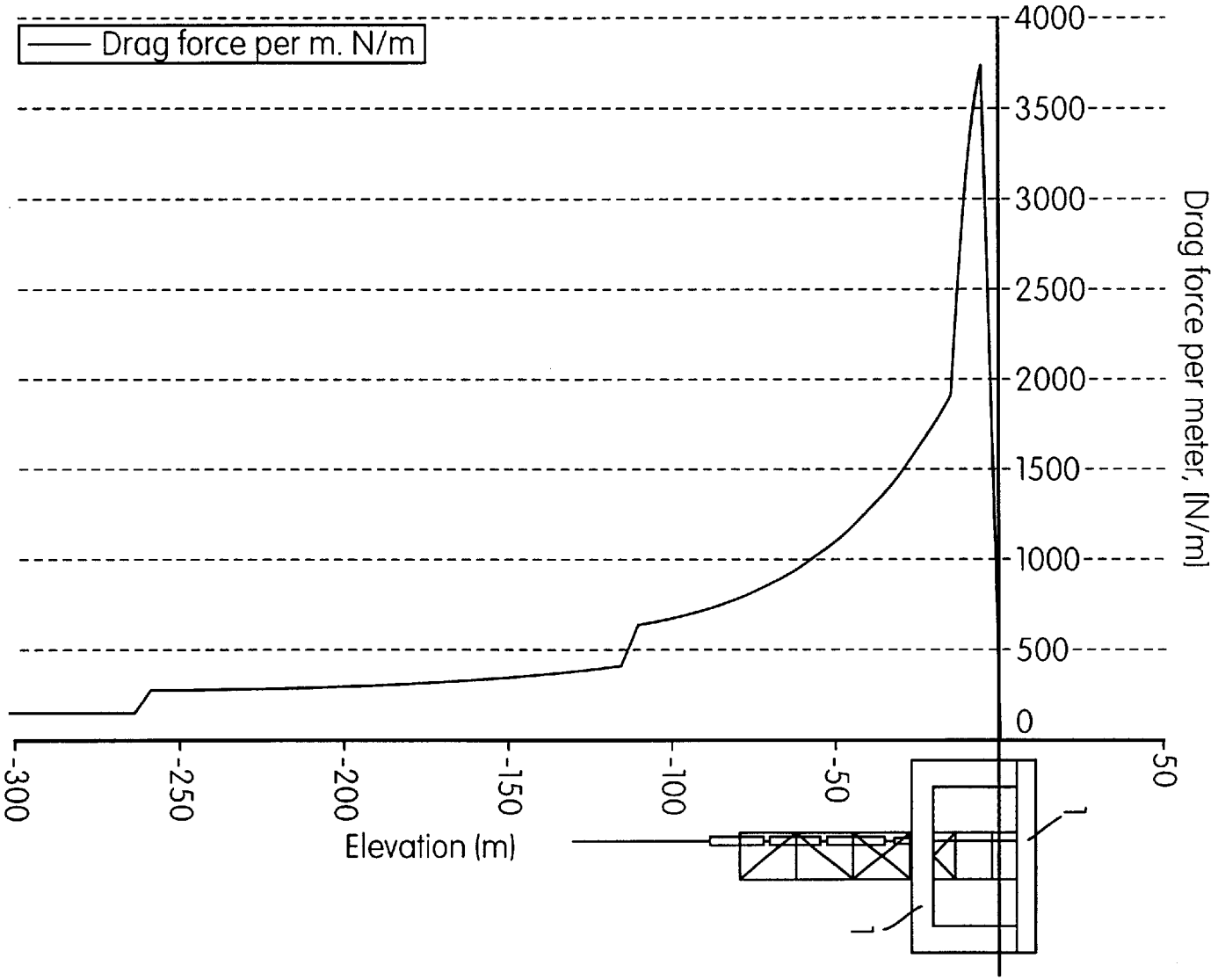

FIG. 8 is a graph of an example of potential drag forces which can be exerted on a riser by current and waves.

Figure 9:
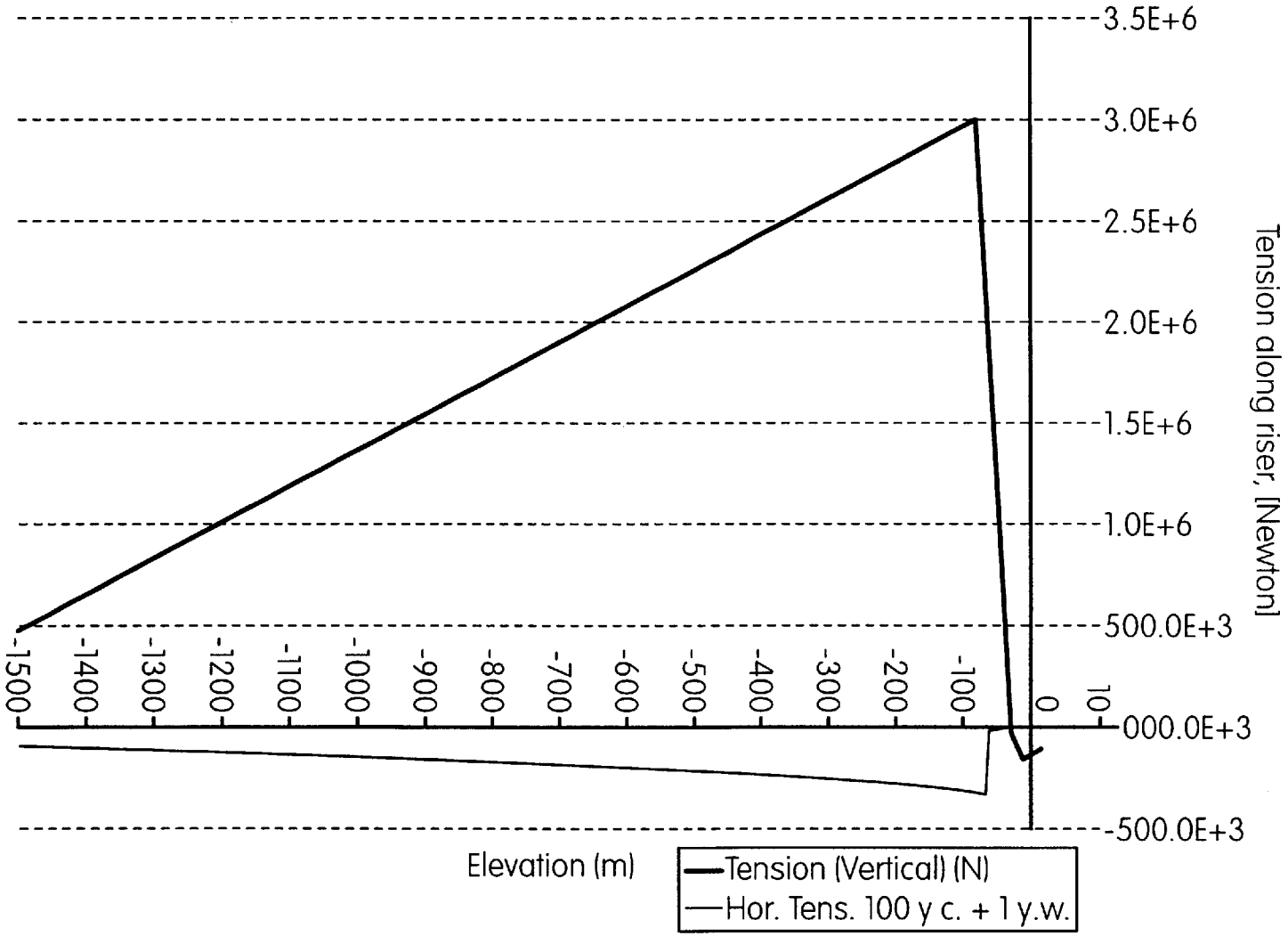

FIG. 9 shows graphs of tension and strain in the riser according to a preferred embodiment of the invention.

Figure 10:
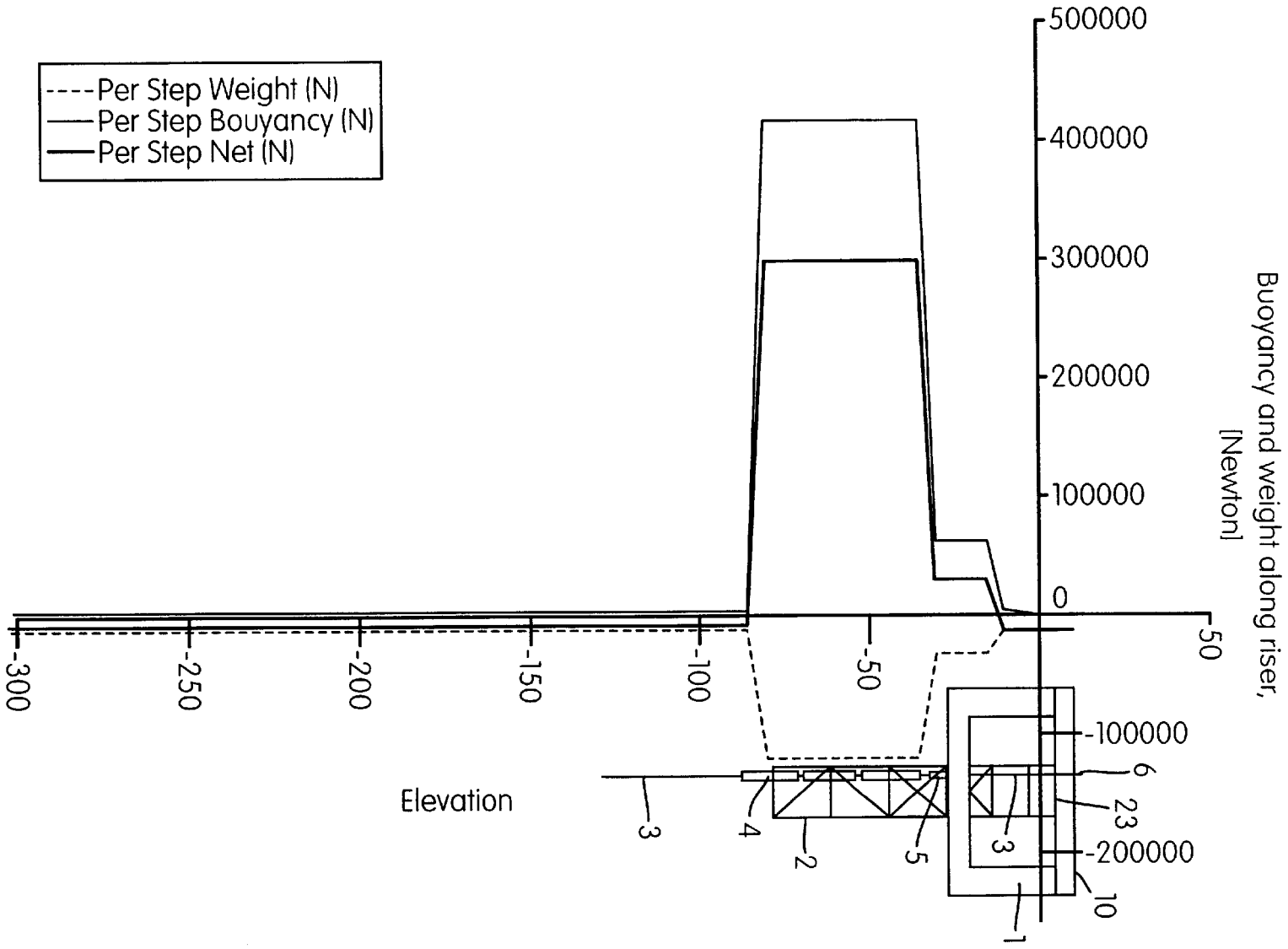

FIG. 10 is the buoyancy and weight along the riser according to a preferred embodiment of the invention.

Figure 11A:
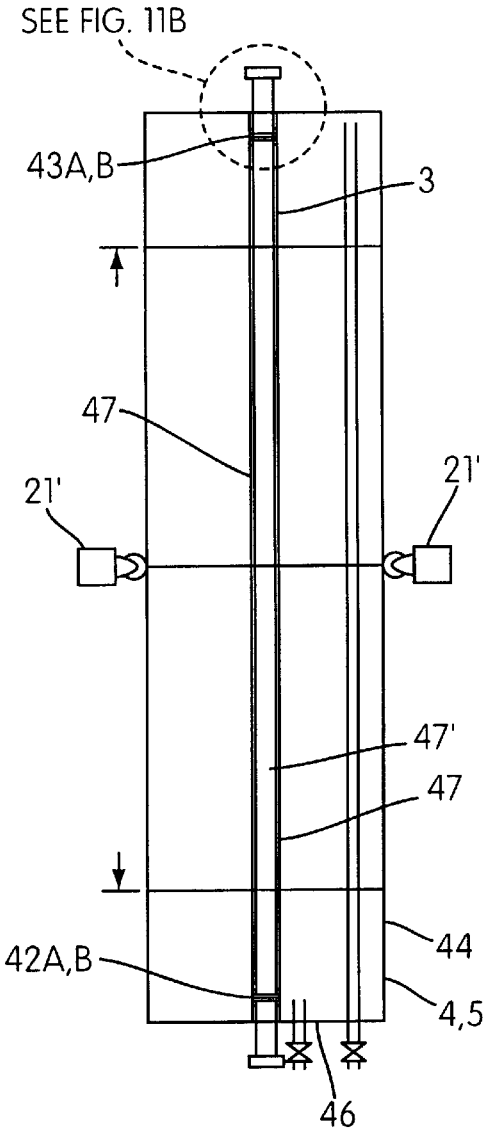

FIG. 11A illustrates a vertical section of a buoyancy element according to the invention.

Figure 11B:
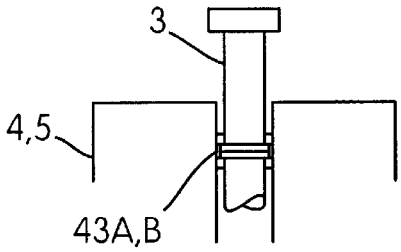

FIG. 11B illustrates an enlargement of a portion of FIG. 11A.

Figure 11C:
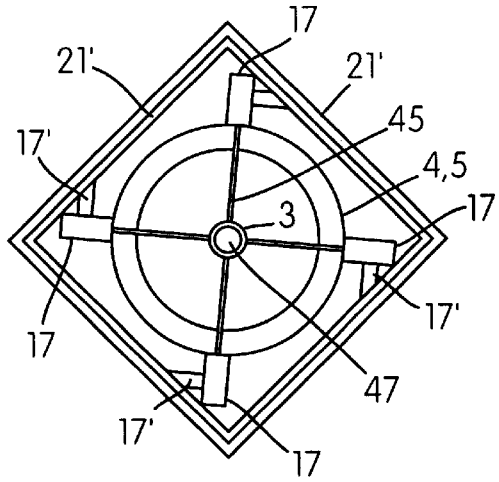

FIG. 11C illustrates a horizontal section of a buoyancy element according to the invention.

Figure 12:
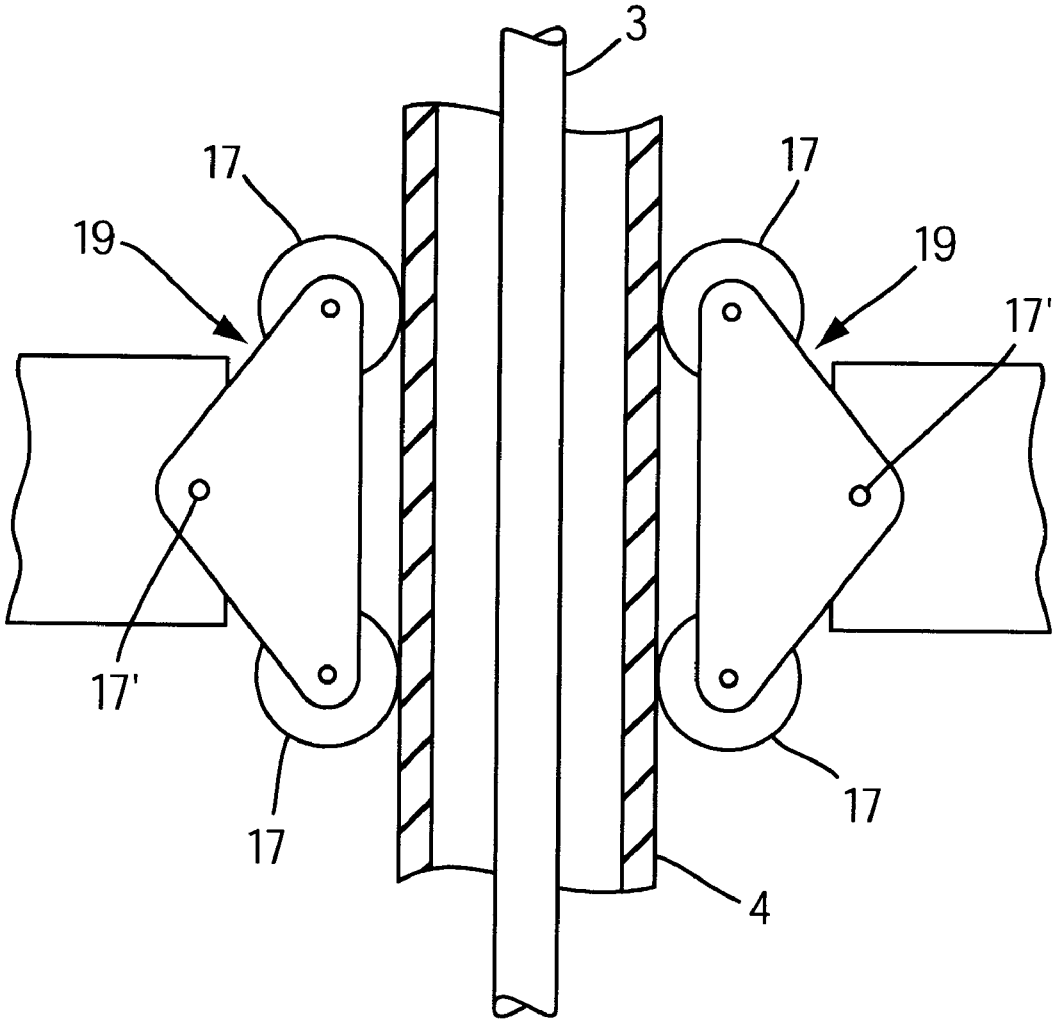

FIG. 12 is a vertical section of a buoyancy element according to an alternative embodiment of the invention.

DESCRIPTION OF A PREFERRED EMBODIMENT OF THE INVENTION

Figure 1A:
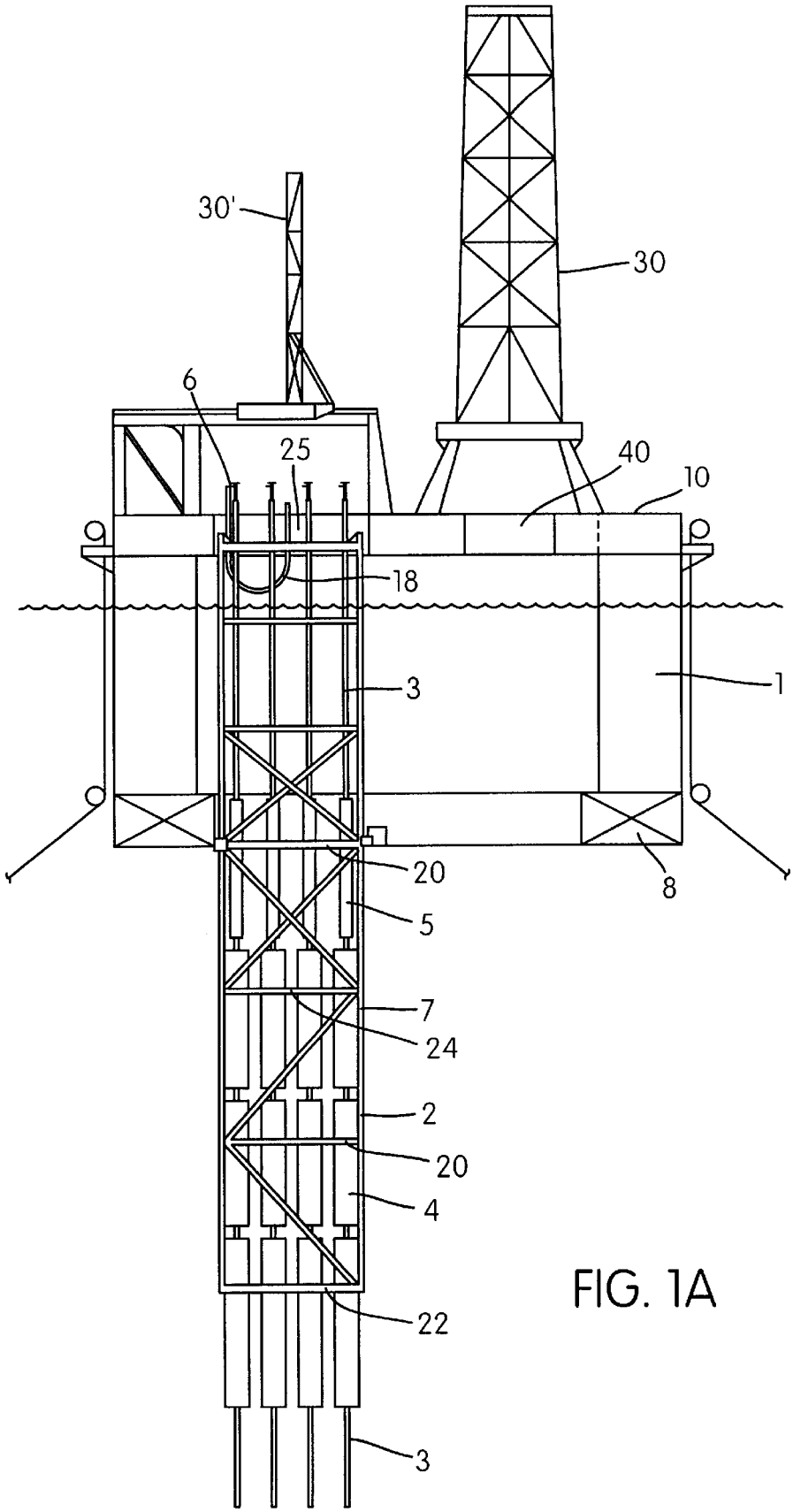

FIG. 1*a* shows a vertical section of a system according to the invention, comprising a semisubmersible platform or vessel 1 with one or more pontoons 8. In a preferred embodiment, the vessel includes a ring pontoon 8, shown in partial vertical section with a guide frame 2 for one or more riser pipes 3. The guide frame 2 is shown arranged in a lower or "submerged" operational position, with the upper part of the guide frame 2 being arranged near the level of the main or weather deck 10 of the platform. In the lower operational position, the frame 2 extends through the splash zone and down through the most strongly influenced wave- and current-influenced zone, to a depth below the pontoon 8.

The guide frame 2 surrounds and guides one or more risers 3 and one or more main buoyancy members 4 and, in a preferred embodiment, auxiliary buoyancy members 5 arranged to carry the weight of the riser 3. The buoyancy members 4,5 are arranged separately on each riser. In a preferred embodiment of the invention, Christmas trees 6 are carried on top of each riser.

FIG. 1 shows an embodiment of the invention, comprising:

a) A guide frame 2 in the form of a framework with vertical main members 7 arranged for extending from the deck 10 of the vessel 1, through the splash zone and down through the most strongly wave- and current-influenced zone to a depth of about 50–150 meters below the sea surface. The vertical members 7 may have rectangular cross-sections.

b) Guide plates 20 for the risers which are arranged in at least two elevation levels: at the lower ends of the vertical main members 7, and at or just beneath the splash zone. Guide plates 20 are also preferably located at deck level and at one or more upper- and intermediate levels.

c) The guide plates 20 have openings 22 defined by a framework 21 (see FIG. 2) arranged for locating and guiding riser pipes 3 and buoyancy members 4,5 in operation and when lowered through the guide frame 2 from above. Each guide plate 20 has stabilizing means 24 (see FIG. 2) for lateral stabilization of the riser pipes 3 and the main- or auxiliary buoyancy members 4,5 extending through the openings 22.

d) The largest buoyancy members or main buoyancy members 4, which carry the main weight of the risers 3, are arranged on each riser pipe at a level near the lower part of the vertical main members 7 of the guide frame 2. There are preferably no buoyancy elements attached to the risers through the splash zone. The reason for having no buoyancy element in the splash zone is illustrated in FIG. 8. FIG. 8 shows that the largest drag force, that is, the zone with current and wave exerting forces on the riser 3, appear in the splash zone and in the upper water masses where waves and current are most dominant. The water movements of surface waves change directions and decrease with increasing depth below the sea surface. The drag force from waves and water current on any exposed rigid element, here a stiff riser with buoyancy elements 4,5, increases with increasing diameter of the riser or the buoyancy member. Because the largest forces appear in the upper masses of water, the radius or diameter of the risers is thus sought to be as small as possible through the splash zone. Moreover, the main buoyancy members 4 with relatively large radii are located rather deeper where the movements of the water are calmer and exert less drag. In addition, the risers 3 and the buoyancy elements 4,5 are restricted against horizontal movements in all levels in the guide frame 2, but are be free to move vertically relative to the guide frame 2. Thus, the vertical movements of each riser 3 are independent of the other risers 3, and also independent of the vertical movements of the platform.

The lower buoyancy can 4 will, in a preferred embodiment of the invention form a "keeljoint" guiding the riser's 3 entrance into the guide frame 2. It is, of course, possible to arrange an extension of our preferred embodiment by extending the vertical main members 7 below the lower guide plate 20 holding the lower buoyancy element 4, to arrange a separate keeljoint for the riser 3.

Figure 1B:
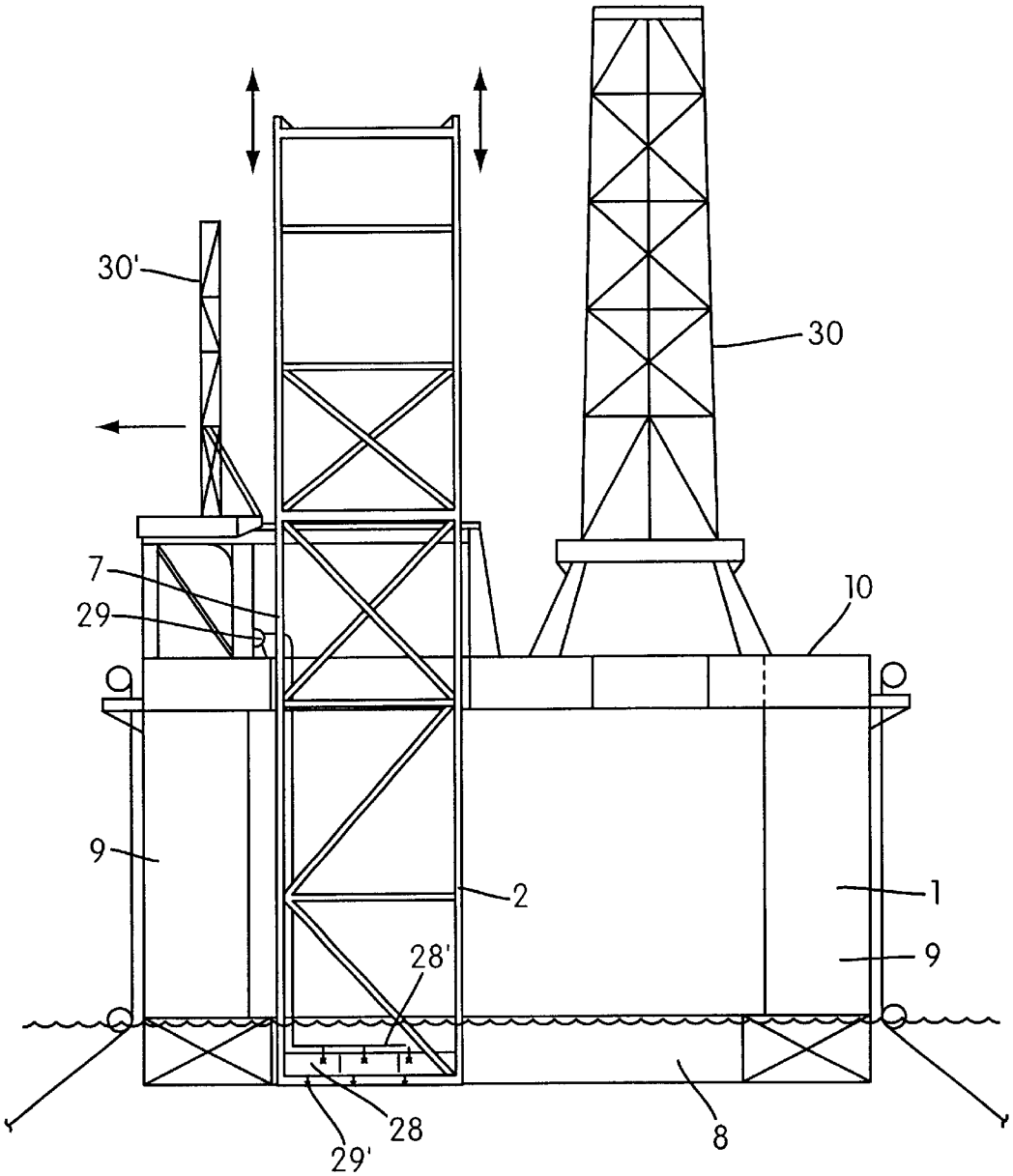

FIG. 1*b* illustrates the same vertical section and view as FIG. 1*a*. In a preferred embodiment of the invention the guide frame 2 for risers 3 can be raised to a position with the lower end of the vertical main members 7 approximately at the same level as the lower end of the ring pontoon 8. This raised position for the guide frame 2 allows for transit with considerably reduced draught and decreased water resistance when platform 1 is deballasted up to be floating on the ring pontoon or the pontoons 8. Thus, the vessel 1 becomes stable during transit.

Hoisting means 26 (not shown) are provided to move the guide frame 2 vertically between an upper position with the lower end of the guide frame 2 positioned at the level of the main pontoon 8, or otherwise the bottom of the vessel, and a lower position with the upper end of the guide frame 2 positioned at the level of the deck 10. The hoisting means 26 can comprise wire drum winches 27 (not shown) on the guide frame and the vessel. Other hoisting devices can be of a hydraulic, mechanical or electromechanical type, and are known in the art. The hoisting means 26 may also be helped by tanks 28 on the part of the guide frame 2 or guide plates 20 being arranged for being lowered below the draft waterline of the vessel 1. The tanks 28 can be arranged both for buoyancy or ballasting of the guide frame 2. The tanks can be provided with compressed-air means 29 and valves 29' or pumps arranged for draining of the water content of the tanks being under the sea surface. The valves 29' can close the tanks.

Figure 2:
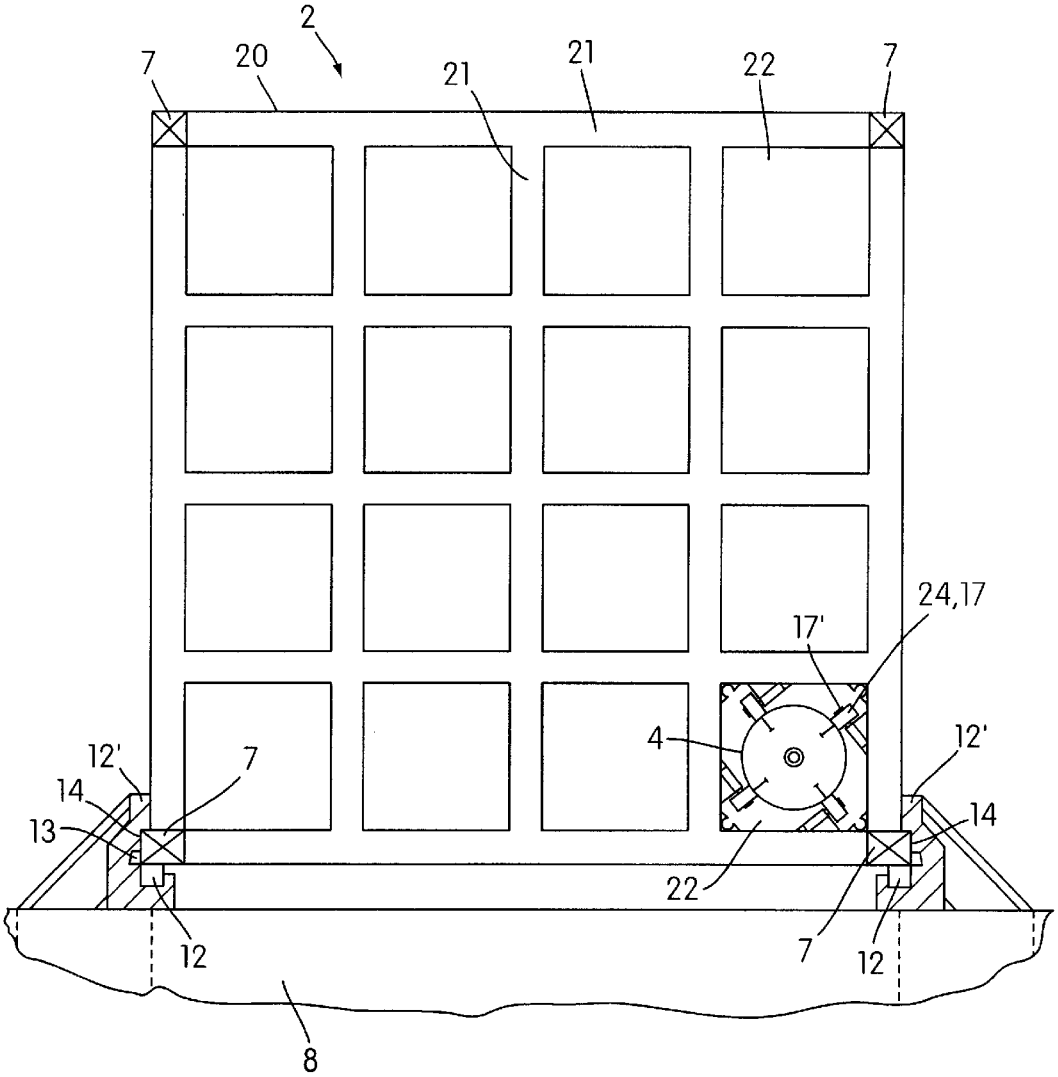
FIG. 2 shows a plan view and partial section of a guide plate in one level of the guide frame, with stabilizing devices for stabilizing a riser pipe and a buoyancy element in the horizontal directions.
Figure 3:
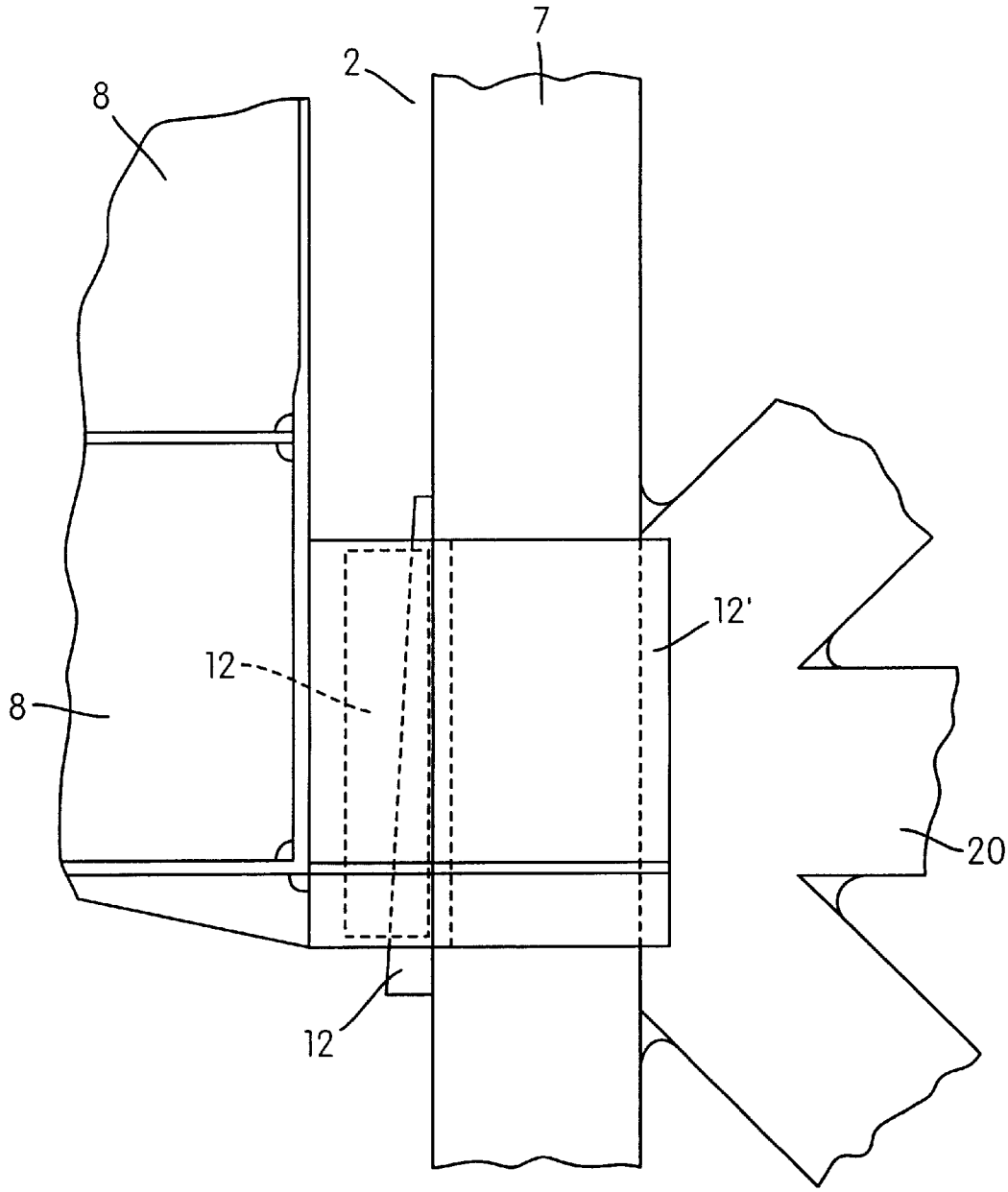
FIG. 3 illustrates a detail of a lower hinge point for attachment of a vertical member of the guide frame against a lower edge of the ring pontoon (section view).

FIG. 2 and FIG. 3 illustrate a plan view and partial side view, respectively, of a guide plate 20 arranged in the guide frame 2. The guide frame 2 is held towards a reinforced inner facing side of the pontoon 8. A fixed holding bracket 12' extends from the inner facing side of the pontoon 8 and includes a flat holding surface facing the pontoon. The bracket 12' is arranged for holding a protruding portion 14 of a vertical main member 7 positioned adjacent the pontoon 8. A holding means 12 is arranged for exerting a horizontal force on the opposite side of the protruding portion of the member 7, forcing the protruding portion 14 towards the fixed holding rail 12'. As shown in FIG. 3, the holding means 12 may comprise a pair of opposed wedges (12, 12) installed between the vertical main member 7 and the bracket 12' for urging the protruding portion 14 into locking engagement with the bracket 12'.

FIG. 2 further illustrates the guide plate 20 comprising, as an example, 4×4 square cells formed of a horizontally arranged framework 21 of beams 21' in each guide plate 20. The holding means 12 can, with the fixed holding rail 12', form a guiding means for guiding and stabilizing the guide frame 2, when it is not positioned in the operative, lower, position, as well as when the guide frame is kept in a completely or partially raised position.

Stabilizing devices 24 for sideways stabilizing of the riser pipes 3 and the main- or auxiliary buoyancy elements 4,5 may, in a preferred embodiment, comprise wheels 17 with horizontal axles 17' arranged in the openings 22 formed by the preferably square cells formed in the guide plates 20. Each wheels' tread surface is directed towards the riser axis and is arranged to roll against the main buoyancy elements 4 or auxiliary buoyancy elements 5, or against the riser pipe 3 in its axial direction, in order for the buoyancy elements 4,5 and the riser pipe 3 to be free to move vertically with respect to the guide plates 20 and the semisubmersible platform 1. In a preferred embodiment, the wheels 17 are arranged in groups, each group comprising four wheels 17 arranged in each square-shaped cell opening in the framework 21. Each wheel 17 is arranged essentially diagonally near a comer of the square cell, with the axle 17' extending horizontally and having an angle of about 40 to 45 degrees deviation from a beam 21' as illustrated in FIG. 2. This arrangement makes space for maintenance of the wheels 17 possible from the free end of the axle 17'. In a preferred embodiment each wheel 17 is arranged somewhat displaced away from a diagonal line of the cell, allowing sufficient space for using a maintenance tool (not illustrated) adapted to exchange and replace a worn or damaged wheel 17 with a replacement wheel 17. A maintenance tool (not illustrated) may be lowered from the deck vertically through the square cells in the framework 21. In the upper parts of the guide frame 2 where the riser does not need buoyancy elements, wheels may be arranged on splittable plates (not illustrated) being hinged in the beams 21' and adapted to pivot 90 degrees up and away from the riser pipe 3, in order to provide clearance for buoyancy elements 4,5 while these are to be set or taken up, and for a maintenance tool passing from the top deck 23 (near the work deck 10) of the guide frame 2, down between the beams 21' of one or more the guide plates 20.

FIG. 3 illustrates an embodiment of the lower holding means 12 arranged to attach the vertical member 7 of the guide frame 2 to the pontoon 8 with a nodal point of a horizontal guide plate 20 held against the reinforced inner face and the lower edge of the ring pontoon 8. In this way horizontal forces from the guide frame 2 are directed along a line into the bottom plates of the pontoon 8, and thus reducing the torque influence of the guide frame 2 on the pontoon 8.

FIG. 4 is a section of the guide frame 2 in an embodiment having an outer flange 25 arranged on the outside of the guide frame 2 near the upper end of the vertical main members 7, and near the top deck 23 of the guide frame 2. The flange 25 is arranged to be supported in a production moonpool frame 25' in the platform deck or production deck 10. In a preferred embodiment, the production moonpool frame 25' is arranged inside and near a vertical projection of the pontoon.

FIG. 4*b* is a more detailed section of top deck 23 of the guide frame 2 with a dry wellhead and Christmas tree 6 arranged on the upper end of the riser 3. The riser 3 is locked laterally in the top deck 23 but is allowed to move vertically (The riser pipe 3 is anchored to the seabed and held in tension by the buoyancy members 4,5. The semisubmersible platform is free to move vertically with respect to the riser pipe 3). Petroleum fluids are conducted via a flexible hose 18 from a wing valve 6' on the Christmas tree 6. The hose 18 hangs in a U-shape under and back up through the platform deck 10 for connection to a valve on the deck 10, where processing and/or export can take place. Alternatively, the U-shaped hose 18 is led up through the top deck 23 of the guide frame as illustrated in FIG. 4B, or entirely above the top deck 23. In a preferred embodiment, a maximum free stroke length of 10,000 mm is estimated for the riser through the top deck 23. The stroke length must be adapted to a locally expected maximum wave amplitude.

FIG. 4*c* shows a plan view of the top deck 23 of the guide frame with openings in each cell for the flexible U-shaped hose 18 leading from the projecting wing valve 6' as described under FIG. 4*b*. In FIG. 4*c*, ¼ of the wing valves 6' are located with oblique azimuth in relation to the rows of riser pipes 3, so that the hose 18 is free to pass freely with respect to the beams 21' of the top deck 23 and the riser pipes 3.

FIG. 5*a* shows (see also FIG. 1*b*) a perspective view of the vessel with the guide frame when it is raised or jacked up with the lower end of the guide frame 2 level with the lower edge of the pontoon 8 (see also FIG. 1*a*).

FIG. 5*b* shows an isometric view of the vessel with the guide frame 2 in submerged operational position and with risers 3, main buoyancy members 4 and auxiliary buoyancy members 5 attached to the risers 3 and kept in the guide plates 20 in the guide frame 2.

FIG. 5*c* illustrates a preferred embodiment of the invention, with a mobile work-over derrick 30' arranged over the guide frame 2 with 4×4 dry wellheads 6 (see FIG. 6) and risers 3 tensioned by buoyancy elements 4 arranged as keeljoints, and optionally auxiliary buoyancy elements 5 arranged above the buoyancy elements 4, and below the splash zone. In this preferred embodiment there is a work-over/wellhead derrick 30' only, without a drilling derrick. Two guide frames may be arranged, one on either side of the work deck and inside and adjacent to the ring pontoon 8.

FIG. 6 is a rough deck plan view of a system according a preferred embodiment of the invention, with a platform 1 with square ring pontoon 8 with a moonpool 25' for production riser pipes 3 and a moonpool 40 for drilling. The drilling moonpool 40 will not be further described here. A derrick 30 is illustrated in FIG. 7. A wellhead derrick 30' (illustrated in FIG. 1A, FIG. 1*b* and FIG. 7) for the riser moonpool 25 is arranged to be movable on a pair of parallel horizontal first rails 32, and a pair of additional horizontal parallel second rails 31 (see FIG. 7) arranged at 90 degrees angle with the first rails 32. The wellhead derrick 30' is arranged for working above any freely selected Christmas tree 6 or riser 3 in the riser moonpool 25'. The top deck 23 of guide frame 2 is illustrated having 4×4 cells, as an example, where 16 Christmas trees 6 are illustrated, each having an obliquely arranged wing valve 6' connected to valves on the deck, and further connected to a manifold 51 and a pipe 51' to a separator 50. From the separator 50 there are arranged a pipeline 54 carrying petroleum fluids to export pumps 57 which further leads to a petroleum fluid export device 60, for example an export riser 60, and another pipeline 55 leading to a "knock out drum" 55' and further to a flare 56.

FIG. 6 and FIG. 1B also illustrate that one pair of the rails, here the rails 32, are arranged with a part extending outside the riser moonpool 25' in order for the wellhead derrick 30' (in a preferred embodiment together with the rails 31) can be displaced horizontally outside and away from the space above the riser moonpool 25' and the guide frame 2, so that the guide frame 2 may be elevated to its upper position as illustrated in FIG. 1B.

FIG. 6 shows a piping arrangement with a boiler 70, a heat exchanger 71 and brine pumps 72 for injection of heated sea water through an annulus (not shown) of the risers 3 between the tubing pipe wall and casing pipe wall. Potential problems are present at the cooling of the petroleum fluid during transport in pipelines. Precipitation of waxes or hydrates can occur when the temperature of the petroleum fluid falls below a temperature depending on the composition of the petroleum fluid, and also depending on the pressure. Hydrate precipitation can take place when the temperature falls below typically 20 degrees C., depending on wellfluid composition. The colder sea water will at normal conditions cool the petroleum fluid down during transport of the fluid up through the extremely long riser, so that waxes and hydrates are precipitated towards the riser pipe, particularly in a startup or a shutdown situation. The same conditions constitutes a considerable problem in connection with transport from widespread satellite wells on the sea bed, with a large distance from a central production platform. In the preferred embodiment, this is solved by means of the injection arrangement comprising brine pumps 72 for heated sea water to the annulus of the risers, so that the temperature of the petroleum fluid does not fall below the critical temperature for the precipitation of waxes or other undesired precipitations.

FIG. 7 is a section of the platform and illustrates the fixed drilling derrick 30 and the completion or work-over derrick 30' movably supported on rails 31 oriented normally to the sectional plan. The derrick 30' can thus be arranged above wells 6 for maintenance or while a new well shall be completed. A new well can be drilled by the drilling derrick 30 at the same time as the wellhead derrick 30' is used to complete a previously drilled well, or to set production risers 3, main buoyancy elements 4 on the riser 3 below the upper wave-influenced zone; auxiliary buoyancy members 5 on the riser above the main buoyancy members 4 and below the splash zone; or glide bearing cups or wheels 17 for vertical free stroke of risers and buoyancy elements through the guide plates 20, or to mount a Christmas tree 6 on each riser and a connection via jumpers preferably comprising flexible hoses 18.

FIG. 8 is a graph of an example of those drag forces which may be exerted on a riser because of forces from current and waves, here shown with the zero level at the sea surface/-draught line for a half submerged position of the vessel 1.

FIG. 9 is a graph of tension in the riser according to a preferred embodiment of the invention, together with the estimated maximum horizontal strain on a riser according to a statistical forecast of the maximum 100-year sea state based on meteorological specifications for a sea area outside the coastal area of West Africa, for example Angola.

FIG. 10 illustrates the buoyancy of a riser (including buoyancy elements) and weight being estimated stepwise along the riser according to a preferred embodiment of the invention. In each level is $$\text{Net buoyancy} = \text{local buoyancy} - \text{local weight}.$$

In the example shown in FIG. 10, the lower main buoyancy members 4 are arranged and attached to the riser in the level approximately 80 meters below the sea surface. It is evident that the auxiliary buoyancy members 5 arranged above the main buoyancy elements 4 carry substantially only the local weight of the riser 3. As shown, buoyancy becomes negative just above the top of the auxiliary buoyancy members 5. Thus, the Christmas tree 6 stands or "rides" on the top end of the vertical stiff riser pipe 3 as intended, resting on the buoyancy members 4,5 and follows the vertical movement of the buoyancy members in the sea. The Christmas tree 6 is according to a preferred embodiment of the invention thus in free movement vertically in relation to the production deck 10 or the top deck 23 of the guide frame, and is connected as described above.

FIG. 11 illustrates a preferred embodiment of the invention showing details of a buoyancy elements 4,5 and its design for cooperating with the wheels 17. Each buoyancy element has an outer right circular cylindrical wall 44 constituting the outer vertical sidewall, and circular endpieces 46 having their periphery welded to the upper and lower ends of the cylindrical wall 44. An inner pipe 47 extends centrally, axially inside the cylindrical wall 44 and forms an open channel 47' through central holes in both endpieces 46. The open channel 47' has a larger inner diameter than the outer diameter of a riser pipe 3 section which shall be arranged inside the buoyancy element 4,5. The larger inner diameter of the open channel 47' allows the riser pipe to curve in order to allow distribution of bend of the section of the riser pipe 3, which is attached to the inner wall of the inner pipe 47 at two locations only. The riser pipe 3 is attached at an upper level by a hangoff shoulder 43A arranged at the riser pipe 3 section, and the shoulder 43A is clamped by an upper clamp arrangement 43B taking up both horizontal and vertical forces. The riser pipe 3 is also attached at a lower level by a horizontally supporting pair of surfaces 42A on the riser pipe 3 section and 42B arranged on the inner wall of the inner pipe 47, allowing a short free relative vertical movement. Thus the section of a riser pipe 3 is allowed to both to stretch and contract, and also to bend somewhat inside the inner pipe 47, and is only fixed vertically to the inner pipe in one upper level at 43A,B, and free to move vertically at 42A,B. Below the lower buoyancy member 4 the riser pipe can be tapered off downwards.

The wheels 17 arranged for running in a relative movement against a buoyancy element 4.5 shall in the preferred embodiment run on the outside of the cylindrical wall 44. The cylindrical wall 44 is backed by a number of reinforcing vertical bulkheads 45 arranged between the inside of the outer cylindrical wall 44 and the corresponding radially "outer" surface of the inner pipe 47. The number of bulkheads 45 corresponds to the number of wheels 17 arranged around the section in each cell. In a preferred embodiment the number of bulkheads and wheels is four. The bulkheads 45 divide the buoyancy members into water-tight compartments preventing complete loss of buoyancy force if a water leakage occurs. The wheels 17 may optionally be arranged in pairs in vertically running bogeys 19 (see FIG. 12) which may pivot around bogey axles which are parallel with the axles 17', and which preferably are arranged in each comer of a cell defined by the beams 21' in a guide plate 20.

For individual ballasting and deballasting of the buoyancy members 4,5, each buoyancy member may be provided with compressed air means and corresponding valves and pipes as illustrated in FIG. 11, arranged for filling or draining of the water containment of the buoyancy members 4,5.

In alternative embodiments of the invention, the guide frame 2 may be entirely or partially submersible for connection to the semisubmersible vessel 1 from the side or underside of the vessel 1. The guide frame 2 can be built separately from the vessel 1 and later be installed, elevated in transit, and thereafter lowered before operation on site. The possibility for raising and lowering the guide frame shall not to be construed as a limitation to the invention.

What is claimed is:

1. A system for use in petroleum production at sea, with a guide frame for one or more risers on a semisubmersible production vessel, with one or more main buoyancy members arranged separately on at least one of said risers to carry the main part of the said riser's weight, each said riser arranged to separately carry a dry Christmas tree on top of said riser, near a main deck of the vessel, wherein:

said main deck of said semisubmersible production vessel is disposed in a spaced-apart relation with respect to a submersible portion of said production vessel so as to form an generally open area at a splash zone between the sea surface and a bottom portion of said main deck, said guide frame comprises vertical main elements arranged to extend vertically downwards from the main deck, through a splash zone and through an upper, more wave- and current-influenced zone of the sea, said guide frame has horizontal guide plates comprising vertically open cells formed of a horizontally arranged framework of beams, with lateral stabilization devices for guiding said risers' and the said main buoyancy members' vertical movement relative to said guide frame and for restricting horizontal movement with respect to said guide frame, said guide plates are arranged in two or more levels on said guide frame; with one lower guide plate arranged in level with the lower ends of the vertical main elements, and one guide plate arranged to be positioned in a level just below or near the splash zone, and at least one said main buoyancy member is arranged for being held on one of said risers in level with, and guided by said lateral stabilization devices arranged in one or more guide plates arranged to be positioned below the upper, more wave- and current-influenced zone near the sea surface, and with the risers being essentially without buoyancy elements through the splash zone.

2. The system of claim 1, wherein at least one main buoyancy member is arranged for being held on said one riser in level with, and guided by said lateral stabilization devices arranged in said lower guide plate, forming a keeljoint between said riser and said vessel.

3. The system of claim 1, wherein said main buoyancy element comprises a right circular cylinder with an outer cylindrical sidewall closed by circular endpieces at the upper and lower ends, comprising an inner pipe extending centrally and axially inside said cylindrical wall and forming an open channel through centrally arranged holes in both said endpieces, said open channel having an inner diameter being larger than the outer diameter of a section of riser pipe, to provide room for curving of said section of said riser pipe inside said channel.

4. The system of claim 3, having one or more auxiliary buoyancy members having lesser diameter than said main buoyancy members, and arranged for being attached on a riser pipe above said at least one main buoyancy member and essentially below the splash zone, and being arranged to carry said riser pipe's local weight above said main buoyancy member.

5. The system of claim 3, having an upper hangoff shoulder arranged at a section of said riser pipe and arranged for being clamped by an upper clamp arrangement in said central channel, designed for taking up both horizontal and vertical forces between said buoyancy element and said riser pipe section, and a pair of horizontally supporting members on said riser pipe section cooperating with a member in said central channel, allowing relative vertical movement of said riser pipe in said channel.

6. The system of claim 1, wherein said stabilization devices for sideways stabilizing of said riser pipes and said main- or auxiliary buoyancy elements comprise wheels with axles arranged in said openings formed by said cells formed by said horizontally lying framework of beams in said guide plates, arranged with said wheels's tread surface to roll against said main buoyancy elements or auxiliary buoyancy elements, or against said riser pipe in the axial (operationally vertical) direction, in order for said buoyancy elements and said riser pipe to be guided vertically with respect to said guide frame and said semisubmersible platform.

7. The system of claim 6, wherein each said wheel is arranged essentially diagonally near a framework node in a cell formed of said beams in said guide plate, directed towards said riser's centerline, with said axle extending horizontally and having an angle of about 40 to 45 degrees deviation from said beam.

8. The system of claim 7, wherein buoyancy members are provided with radial, standing bulkheads arranged between an inner side of said outer cylindrical wall and a corresponding radially outer cylindrical surface of said inner pipe, the number of bulkheads corresponding to the number of wheels arranged around said buoyancy member, said bulkheads being arranged as a backing of said cylindrical wall against forces from said wheels running on an outer side of said cylindrical wall.

9. The system of claim 8, wherein at least one of said buoyancy members comprise at least four bulkheads.

10. The system of claim 7, wherein one or more pair of wheels is arranged in one or more vertically running bogeys, each said of said bogeys rotatable around a bogey axle being parallel with said axles of said wheels.

11. The system of claim 7, wherein said wheels are arranged in groups comprising four wheels arranged in each said cell opening in said framework.

12. The system of claim 6, wherein in the upper parts of the guide frame where said riser is not provided with buoyancy elements, said wheels are arranged on splittable plates being hinged in said beams and arranged for being turned 90 degrees up and away from said riser pipe, in order to give free path for said buoyancy elements while said buoyancy members are to be lowered or taken up, and while a maintenance tool shall pass from the main deck down between the beams of one or more the guide plates of the guide frame.

13. The system of claim 1, wherein all levels of said guide plates comprising vertically open cells formed of said horizontally arranged framework of beams are arranged for setting of at least a largest of said main buoyancy members on said riser pipe from above.

14. The system of claim 1, wherein one or more intermediately arranged guide plates arranged in a separate level on said guide frame; above said lower guide plate arranged in level with the lower ends of said vertical main elements', and below said guide plate arranged in a level just below or near the splash zone, and above the splash zone.

15. The system of claim 1, having a derrick being arranged movable on a pair of first horizontal rails, and an additional second pair of horizontal rails arranged at right angles with respect to said first rails.

16. The system of claim 15, wherein said rails are arranged with an end part of each of said rails extending outside of a riser moonpool and arranged to allow said derrick, together with said second pair of rails, to be displaced horizontally away from the space above the riser moonpool and outside said guide frame so there is formed a vertical free passage over the entire of said riser moonpool for said guide frame.

17. The system of claim 1, having hoisting means arranged to transfer the guide frame vertically between a lower position with the upper end of said guide frame arranged in deck level, and a raised position with said lower end of said guide frame arranged in level with said main pontoon or bottom of said vessel.

18. The system of claim 17, wherein said hoisting means comprises wire drum winches.

19. The system of claim 1, having tanks on a part of the guide frame being arranged for submersion in water, said tanks being arranged for buoyancy or ballasting of said guide frame.

20. The system of claim 19, wherein said tanks are provided with a source of compressed air arranged for draining of the water containment of said tanks under the sea surface.

21. The system of claim 1, wherein the number of vertical main elements is four, and that said guide frames are mainly square or rectangular.

22. A guide frame adapted for arrangement on a semisubmersible petroleum production vessel having a main deck for use at large sea depths, wherein said main deck of said semisubmersible vessel is disposed in a spaced-apart relation with respect to a submersible portion of said vessel so as to form an generally open area at a splash zone between the sea surface and a bottom portion of said main deck, said guide frame being adapted for guiding riser pipes extending from the sea floor to the level of said main deck and for guiding buoyancy members arranged on said riser pipes, said riser pipes being arranged to carry a Christmas tree on top of each said riser pipe, said guide frame comprising:

a) main members for vertical arrangement from said main deck of said vessel, through the splash zone and down below the upper wave- and current-influenced zone of the sea, and b) guide plates for said riser pipes arranged on said guide frame: at a lower end of said vertical main members, at or just below the splash zone, and at one or more intermediate levels;

c) wherein said guide plates are arranged with openings for setting of said riser pipes and buoyancy members, and with members for lateral stabilization of said riser pipes and said buoyancy members.

23. A buoyancy element for a petroleum production riser, in which said buoyancy element comprises a right circular cylinder with an outer cylindrical sidewall closed by circular endpieces at its upper and lower ends, the buoyancy element comprising:

an inner pipe extending centrally and axially inside said cylindrical sidewall and forming an open channel through centrally arranged holes in both of said endpieces, said open channel having an inner diameter being larger than the outer diameter of a section of said riser pipe, to provide room for curving of said section of riser pipe inside said channel, and an upper clamp arrangement in said central channel, arranged for clamping an upper hangoff shoulder at a section of said riser pipe and arranged for taking up both horizontal and vertical forces between said buoyancy element and said riser pipe section, and a horizontally supporting member arranged in the lower part in the central channel, allowing a free relative vertical movement of said riser pipe in said channel.

24. A semisubmersible production platform with dry wellheads and Christmas trees, a guide frame for one or more riser pipes, and a buoyant vessel with a main deck, wherein said main deck of said buoyant vessel is disposed in a spaced-apart relation with respect to a submersible portion of said vessel so as to form an generally open area at a splash zone between the sea surface and a bottom portion of said main deck, one or more buoyancy members are arranged separately on at least one of said risers to carry the main part of said riser's weight, each riser is arranged to separately carry a Christmas tree on top, near the main deck of said vessel, said guide frame comprises vertical main elements arranged for extending vertically downwards from the main deck, through the splash zone and through the upper, more wave- and current-influenced zone of the sea, said guide frame has horizontal guide plates comprising vertically open cells formed of a horizontally arranged framework of beams, with lateral stabilization devices for guiding said risers' and said buoyancy members' vertical movement relative to said guide frame and restricting the horizontal movement of said risers and buoyancy members with respect to said guide frame, said guide plates are arranged in at least two levels on said guide frame; with a lower guide plate arranged in level with the lower ends of said vertical main elements and a guide plate arranged to be positioned in a level just below or near the splash zone, and one main buoyancy member is arranged for being held on said riser in level with, and guided by said lateral stabilization devices arranged in at least one of said guide plates arranged to be positioned below the upper, more wave- and current-influenced zone near the sea surface.

25. An assembly for petroleum production at sea comprising:

a vessel comprising a buoyant section, a main deck, and a plurality of support elements supporting said main deck in spaced-apart relation with respect to said buoyant section such that at least a top surface of said main deck is held above the sea surface by the buoyancy of said buoyant section when said buoyant section is at least partially submerged below the sea surface;

at least one riser extending from the sea floor to the level of said main deck;

one or more buoyancy members secured to said at least one riser for buoyantly supporting a portion of the weight of said at least one riser;

guide structure secured to said vessel and extending to a depth below a region of significant wave and current-induced forces; and lateral stabilization devices operatively engaged with said at least one riser and associated buoyancy members and secured to said guide structure at spaced apart positions thereon, said lateral stabilization devices being constructed and arranged to restrict lateral movement of said at least one riser and associated buoyancy members with respect to said guide structure and to permit relative vertical movement of said guide structure with respect to said at least one riser and associated buoyancy member.

26. The assembly of claim 25, wherein said guide structure is secured to said vessel vertically movable with respect to said vessel between (a) a deployed position in which a lower end of said guide structure extends to the depth below the region of significant wave and current-induced forces and (b) a stowed position in which the guide structure is raised relative to the deployed position.

27. The assembly of claim 26, wherein said guide structure is secured to said vessel vertically movable with respect to said vessel between (a) the deployed position in which the lower end of said guide structure extends to the depth below the region of significant wave and current-induced forces and (b) the stowed position in which the lower end of the guide structure is at about the level of the buoyant section of the vessel.

28. The assembly of claim 25, wherein said buoyant section of said vessel comprises a ring pontoon.

29. The assembly of claim 25, wherein said guide structure extends from said main deck, through a splash zone between said main deck and said buoyant section, and to the depth below significant wave and current-induced forces.

30. The assembly of claim 25, wherein said one or more buoyancy members associated with each riser comprise at least one main buoyancy member having a shape of a right circular cylinder with a central axial passageway for receiving said riser and at least one auxiliary buoyancy member having a shape of a right circular cylinder with a central axial passageway for receiving said at least one riser, wherein said at least one auxiliary buoyancy member has a smaller outer diameter than said at least one main buoyancy member, and wherein said at least one auxiliary buoyancy member is disposed above said main buoyancy member on said at least one riser.

31. The assembly of claim 25, wherein said lateral stabilization devices comprise wheels rotatably mounted on axles on said guide structure so as to roll in an axial direction with respect to an outer surface of a riser or associated buoyancy member with which said wheels are operatively engaged.

32. The assembly of claim 25, wherein said guide structure includes two or more guide plates, each comprising a generally horizontally arranged framework of beams defining vertically open cells for receiving risers, wherein one of said guide plates is disposed at a lower end of said guide structure and another of said guide plates is disposed at or just below a splash zone between said main deck and said buoyant section.

33. The assembly of claim 25, further comprising a derrick mounted on said main deck so as to be horizontally movable in either of two orthogonal directions.

34. The assembly of claim 25, wherein said guide structure extends down to a depth of about 50–150 meters below the sea surface.

35. The assembly of claim 25, further comprising a derrick mounted on said main deck so as to be horizontally movable completely away from a riser moonpool to allow said guide structure to be raised to an elevation such that a bottom end of said guide structure is flush with the bottom of said buoyant section of said vessel.

* * * * *